US010111312B2

(12) United States Patent
Suzuki et al.

(10) Patent No.: US 10,111,312 B2
(45) Date of Patent: Oct. 23, 2018

(54) EXTREME ULTRAVIOLET LIGHT GENERATION DEVICE

(71) Applicant: Gigaphoton Inc., Tochigi (JP)

(72) Inventors: Toru Suzuki, Oyama (JP); Kotaro Miyashita, Oyama (JP); Yoshifumi Ueno, Oyama (JP); Takuya Ishii, Oyama (JP)

(73) Assignee: Gigaphoton Inc., Tochigi (JP)

( * ) Notice: Subject to any disclaimer, the term of this patent is extended or adjusted under 35 U.S.C. 154(b) by 0 days.

(21) Appl. No.: 15/807,067

(22) Filed: Nov. 8, 2017

(65) Prior Publication Data

US 2018/0077785 A1 Mar. 15, 2018

Related U.S. Application Data

(63) Continuation of application No. PCT/JP2015/067678, filed on Jun. 19, 2015.

(51) Int. Cl.
*H05G 2/00* (2006.01)

(52) U.S. Cl.
CPC ..... *H05G 2/005* (2013.01); *H05G 2/006* (2013.01); *H05G 2/008* (2013.01)

(58) Field of Classification Search
CPC ..... H05G 2/005; H05G 2/008; H05G 2/006
USPC ..... 250/493.1, 504 R
See application file for complete search history.

(56) References Cited

U.S. PATENT DOCUMENTS

2001/0048084 A1 12/2001 Uzawa
2014/0216576 A1* 8/2014 Someya ..... H05G 2/008 137/560
2014/0284502 A1* 9/2014 Nakano ..... H05G 2/008 250/504 R
2014/0353528 A1* 12/2014 Hayashi ..... H05G 2/008 250/504 R

FOREIGN PATENT DOCUMENTS

JP S63-263449 A 10/1988
JP H09-174274 A 7/1997
JP 2001-034524 A 2/2001
JP 2001-345248 A 12/2001
JP 2014-154229 A 8/2014
JP 2014-186846 A 10/2014
JP 2014-235805 A 12/2014

OTHER PUBLICATIONS

International Search Report issued in PCT/JP2015/067678; dated Sep. 15, 2015.
International Preliminary Report on Patentability and Written Opinion of the International Searching Authority issued in PCT/JP2015/067678; dated Dec. 19, 2017.

* cited by examiner

*Primary Examiner* — Michael Maskell
(74) *Attorney, Agent, or Firm* — Studebaker & Brackett PC

(57) ABSTRACT

Output timing of laser light is controlled with high accuracy. An extreme ultraviolet light generation device may include a chamber in which plasma is generated to generate extreme ultraviolet light, a window provided in the chamber, an optical path pipe connected to the chamber, a light source disposed in the optical path pipe and configured to output light into the chamber via the window, a gas supply unit configured to supply gas into the optical path pipe, and an (Continued)

exhaust port configured to discharge the gas in the optical path pipe to an outside of the optical path pipe.

19 Claims, 19 Drawing Sheets

EXTREME ULTRAVIOLET LIGHT GENERATION DEVICE

CROSS-REFERENCE TO RELATED APPLICATIONS

The present application is a continuation application of International Application No. PCT/JP2015/067678 filed on Jun. 19, 2015. The content of the application is incorporated herein by reference in its entirety.

BACKGROUND

1. Technical Field

The present disclosure relates to an extreme ultraviolet light generation device.

2. Related Art

In recent years, along with miniaturization of a semiconductor process, miniaturization of a transfer pattern in photolithography of a semiconductor process has been developed rapidly. In the next generation, fine processing of 70 nm to 45 nm, and further, fine processing of 32 nm or less will be demanded. In order to meet a demand for fine processing of 32 nm or less, for example, it is expected to develop an exposure device in which a device for generating extreme ultraviolet (EUV) light having a wavelength of about 13 nm and reduced projection reflective optics are combined.

As EUV light generation devices, three types of devices are proposed, namely an LPP (Laser Produced Plasma) type device using plasma generated by radiating laser light to a target substance, a DPP (Discharge Produced Plasma) type device using plasma generated by electric discharge, and an SR (Synchrotron Radiation) type device using orbital radiation light.

CITATION LIST

Patent Literature

Patent Literature 1: Japanese Patent Application Laid-Open No. 9-174274

Patent Literature 2: Japanese Patent Application Laid-Open No. 63-263449

Patent Literature 3: Japanese Patent Application Laid-Open No. 2001-34524

Patent Literature 4: Japanese Patent Application Laid-Open No. 2014-154229

SUMMARY

An extreme ultraviolet light generation device, according to one aspect of the present disclosure, may include a chamber, a window, an optical path pipe, a light source, a gas supply unit, and an exhaust port. The chamber may be configured such that plasma is generated therein whereby extreme ultraviolet light is generated. The window may be provided in the chamber. The optical path pipe may be connected to the chamber. The light source may be disposed in the optical path pipe and configured to output light into the chamber via the window. The gas supply unit may be configured to supply gas into the optical path pipe. The exhaust port may be provided for discharging the gas in the optical path pipe to an outside of the optical path pipe.

An extreme ultraviolet light generation device, according to one aspect of the present disclosure, may include a chamber, a window, an optical path pipe, a light receiving element, a gas supply unit, and an exhaust port. The chamber may be configured such that plasma is generated therein whereby extreme ultraviolet light is generated. The window may be provided in the chamber. The optical path pipe may be connected to the chamber. The light receiving element may be disposed in the optical path pipe and configured to receive light from the inside of the chamber via the window. The gas supply unit may be configured to supply gas into the optical path pipe. The exhaust port may be provided for discharging the gas in the optical path pipe to an outside of the optical path pipe.

An extreme ultraviolet light generation device, according to one aspect of the present disclosure, may include a chamber, a window, an optical path pipe, a light source, and a device. The chamber may be configured such that plasma is generated therein whereby extreme ultraviolet light is generated. The window may be provided in the chamber. The optical path pipe may be connected to the chamber. The light source may be disposed in the optical path pipe and configured to output light into the chamber via the window. The device may make refractive index distribution in the optical path pipe uniform.

BRIEF DESCRIPTION OF THE DRAWINGS

Some embodiments of the present disclosure will be described below as just examples with reference to the accompanying drawings.

EMBODIMENTS

Contents

Figure 1:
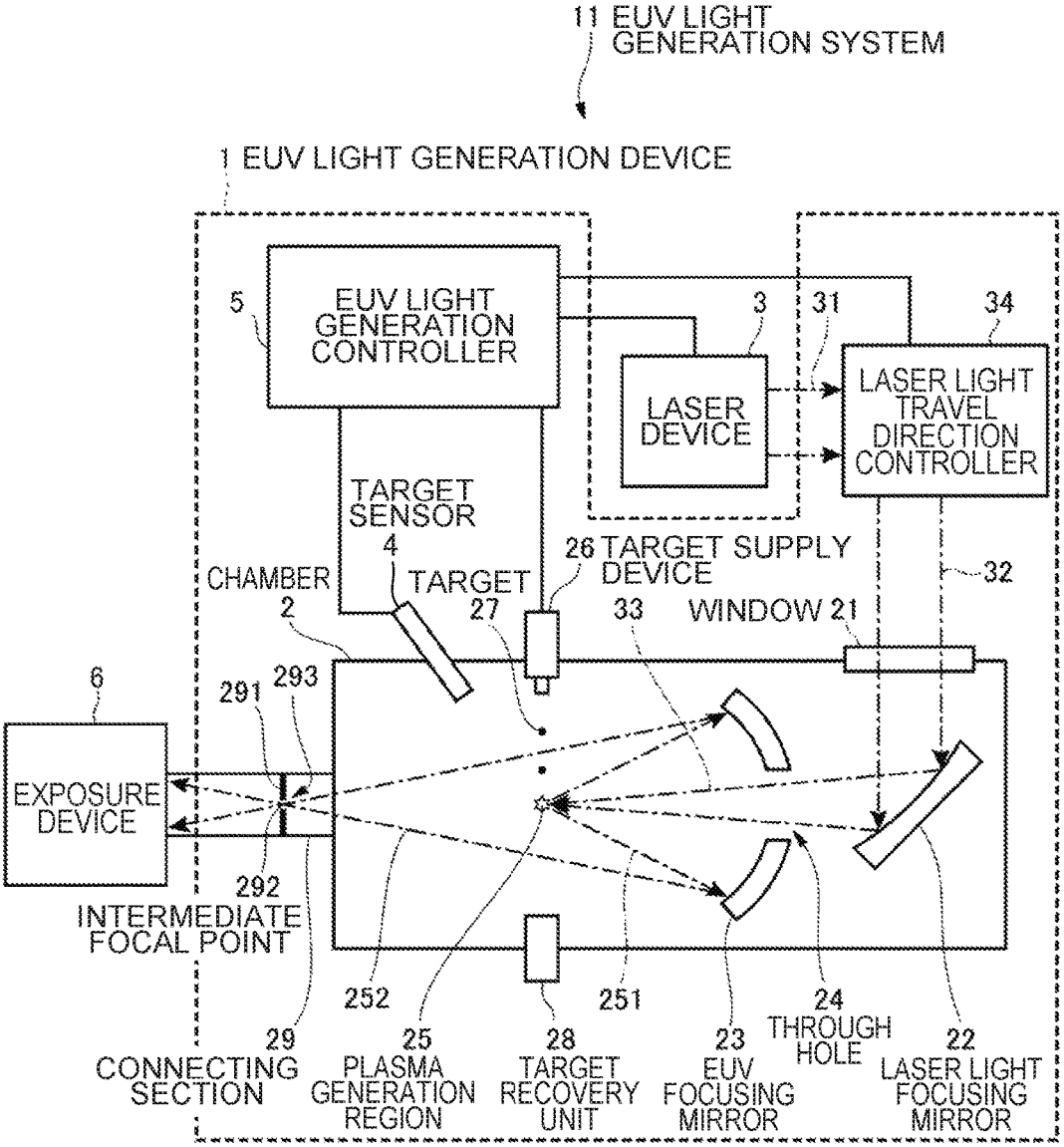
FIG. 1 is a diagram schematically illustrating a configuration of an exemplary LPP type EUV light generation system.

1. Overview
2. Terms
3. Overall description of EUV light generation system
   3.1 Configuration
   3.2 Operation
4. EUV light generation device provided with droplet detector
   4.1 Configuration
   4.2 Operation
5. Problem
6. EN light generation device of first embodiment
   6.1 Configuration
   6.2 Operation
   6.3 Effect
   6.4 Modification 1 of first embodiment
7. EUV light generation device of second embodiment
8. EUV light generation device of third embodiment
   8.1 Droplet detector
   8.2 droplet trajectory measurement device
   8.3 droplet image measurement device
9. EUV light generation device of fourth embodiment
   9.1 Configuration
   9.2 Operation
   9.3 Effect
10. EUV light generation device of fifth embodiment
11. Others
   11.1 Hardware environment of each controller
   11.2 Other modifications and the like Hereinafter, embodiments of the present disclosure will be described in detail with reference to the drawings. The embodiments described below illustrate some examples of the present disclosure and do not limit the contents of the present disclosure. All of the configurations and the operations described in the embodiments are not always indispensable as configurations and operations of the present disclosure. It should be noted that the same constituent elements are denoted by the same reference numerals, and overlapping description is omitted.

1. Overview

The present disclosure can at least disclose the embodiments described below as just examples.

An EUV light generation device 1 of the present disclosure may include a chamber 2 in which plasma is generated therein whereby EUV light 252 is generated, a window 411 provided in the chamber 2, an optical path pipe 412 connected to the chamber 2, a light source 413 disposed in the optical path pipe 412 and configured to output light to the chamber 2 via the window 411, a gas supply unit 71 configured to supply gas into the optical path pipe 412, and an exhaust port 412*e* for exhausting the gas in the optical path pipe 412 to an outside of the optical path pipe 412.

With this configuration, the EUV light generation device 1 can control the output timing of pulse laser light 31 with high accuracy.

2. Terms

"Target" is an object irradiated with laser light introduced into the chamber. A target irradiated with laser light is made into plasma and radiates EUV light.

"Droplet" is a mode of a target to be supplied to the chamber.

"Droplet trajectory" is a path on which a droplet output into the chamber travels. The droplet trajectory may intersect with an optical path of laser light introduced into the chamber in a plasma generation region.

"Plasma light" is radiated light radiated from a target that was made into plasma. The radiated light includes EUV light.

"Optical path axis" is an axis passing through a center of a beam cross section of laser light along a travel direction of the laser light.

"Optical path" is a path through which laser light passes. The optical path may include an optical path axis.

3. Overall Description of EUV Light Generation System

3.1 Configuration

FIG. 1 schematically illustrates a configuration of an exemplary LPP type EUV light generation system.

An EUV light generation device 1 may be used together with at least one laser device 3. In the present application, a system including the EUV light generation device 1 and the laser device 3 is called an EUV light generation system 11. As illustrated in FIG. 1 and as described below in detail, the EUV light generation device 1 may include a chamber 2 and a target supply unit 26. The chamber 2 may be sealable. The target supply unit 26 may be provided in such a manner as to penetrate a wall of the chamber 2, for example. A material of a target 27 supplied from the target supply unit 26 may include, but not limited to, tin, terbium, gadolinium, lithium, xenon, or a combination of any two or more of them.

A wall of the chamber 2 may be provided with at least one through hole. The through hole may be provided with a window 21. Pulse laser light 32 output from the laser device 3 may penetrate the window 21. Inside the chamber 2, an EUV focusing mirror 23 having a spheroidal reflection surface, for example, may be disposed. The EUV focusing mirror 23 may have first and second focal points. On a surface of the EUV focusing mirror 23, a multilayer reflection film in which molybdenum and silicon are alternately layered, for example, may be formed. It is preferable that the EUV focusing mirror 23 is disposed such that the first focal point locates in the plasma generation region 25 and the second focal point locates at an intermediate focal point (IF) 292, for example. The EUV focusing mirror 23 may have a through hole 24 in a center portion thereof, and the pulse laser light 33 may pass through the through hole 24.

The EUV light generation device 1 may include an EUV light generation controller 5, a target sensor 4, and the like.

The target sensor 4 may have an image capturing function, and may be configured to detect presence, trajectory, position, velocity, and the like of the target 27.

The EUV light generation device 1 may also include a connecting section 29 configured to communicate an inside of the chamber 2 and an inside of an exposure device 6 with each other. In the connecting section 29, a wall 291 having an aperture 293 may be provided. The wall 291 may be disposed such that the aperture 293 locates at a second focal point position of the EUV focusing mirror 23.

Moreover, the EUV light generation device 1 may include a laser light travel direction controller 34, a laser light focusing mirror 22, a target recovery unit 28 for recovering the target 27, and the like. The laser light travel direction controller 34 may have an optical element for defining the travel direction of the laser light, and an actuator for regulating the position, posture, and the like of the optical element.

3.2 Operation

Referring to FIG. 1, the pulse laser light 31 output from the laser device 3 may pass through the laser light travel direction controller 34 and penetrate the window 21 as pulse laser light 32 to enter the chamber 2. The pulse laser light 32 may travel inside the chamber 2 along at least one laser light path, and may be reflected by the laser light focusing mirror 22 and radiated as pulse laser light 33 to at least one target 27.

The target supply unit 26 may be configured to output the target 27 toward the plasma generation region 25 in the chamber 2. The target 27 may be irradiated with at least one pulse included in the pulse laser light 33. The target 27 irradiated with the pulse laser light 33 is made into plasma, and from the plasma, EUV light 251 may be radiated along with radiation of light having a different wavelength. The EUV light 251 may be reflected selectively by the EUV focusing mirror 23. The EUV light 252 reflected by the EUV focusing minor 23 may be focused at an intermediate focal point 292 and output to the exposure device 6. One target 27 may be irradiated with a plurality of pulses included in the pulse laser light 33.

The EUV light generation controller 5 may be configured to integrate control of the entire EUV light generation system 11. The EUV light generation controller 5 may be configured to process image data or the like of the target 27 captured by the target sensor 4. Further, the EUV light generation controller 5 may perform at least one of control of the timing when the target 27 is output and control of the target 27 output direction or the like, for example. Furthermore, the EUV light generation controller 5 may perform at least one of control of the output timing of the laser device 3, control of the travel direction of the pulse laser light 32, and control of the light focusing position of the pulse laser light 33, for example. The various types of control described above are merely examples, and another type of control can be added when necessary.

4. EUV Light Generation Device Provided with Droplet Detector

4.1 Configuration

A configuration of the EUV light generation device 1 provided with a droplet detector 41 will be described using FIGS. 2 to 5.

Figure 2:
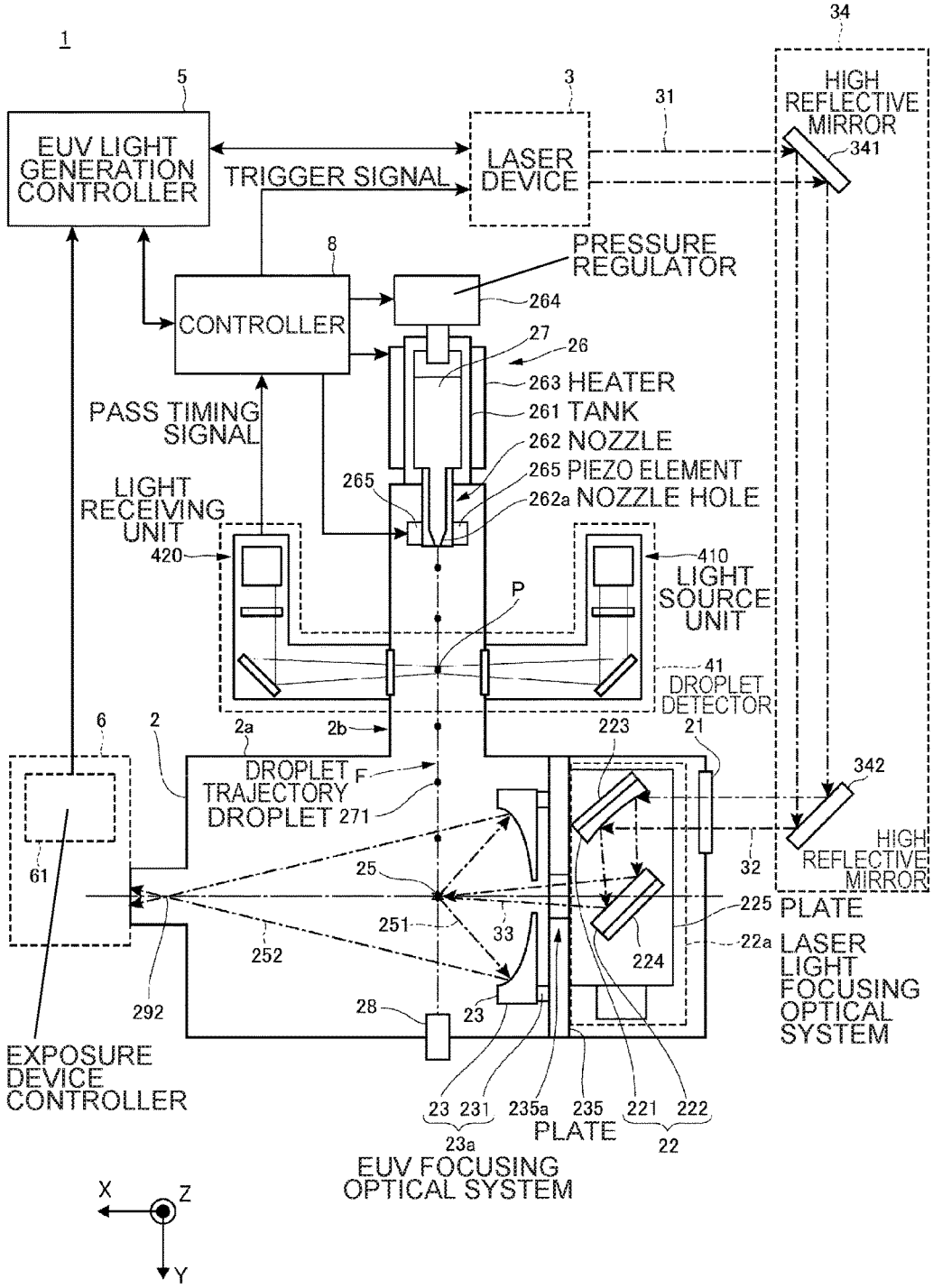
FIG. 2 is a diagram for explaining a configuration of an EUV light generation device provided with a droplet detector.

FIG. 2 is a diagram for explaining a configuration of the EUV light generation device 1 provided with the droplet detector 41.

In FIG. 2, a direction of outputting EUV light 252 from the chamber 2 of the EUV light generation device 1 toward an exposure device 6 is referred to as an X axis direction, and a direction orthogonal to the X axis direction and along a droplet trajectory F is referred to as a Y axis direction. A Z axis direction is a direction orthogonal to the X axis direction and the Y axis direction. The coordinate axes of FIG. 2 also apply to the subsequent drawings.

The chamber 2 of the EUV light generation device 1 may be a container in which the pulse laser light 33 is radiated to a target 27 supplied therein whereby the EUV light 252 is generated, as described above.

The chamber 2 may be formed in a hollow cylindrical shape, for example.

A wall 2*a* forming the inner space of the chamber 2 may be made of a material having conductivity.

The center axis direction of the cylindrical chamber 2 may be substantially parallel to the direction of outputting the EUV light 252 to the exposure device 6.

The chamber 2 may include a target supplying path 2*b* for supplying the target 27 from the outside of the chamber 2 to the inside of the chamber 2.

The target supplying path 2*b* may be provided on a side face part of the cylindrical chamber 2.

The target supplying path 2*b* may be formed in a cylindrical shape.

The center axis direction of the cylindrical target supplying path 2*b* is substantially orthogonal to the direction of outputting the EUV light 252 to the exposure device 6.

The inside of the chamber 2 may be provided with a laser light focusing optical system 22*a*, an EUV focusing optical system 23*a*, a target recovery unit 28, a plate 225, and a plate 235.

The outside of the chamber 2 may be provided with a laser light travel direction controller 34, an EUV light generation controller 5, a target supply unit 26, the droplet detector 41, and a controller 8.

The plate 235 may be fixed on the inner surface of the chamber 2.

The center of the plate 235 may have a hole 235*a* through which the pulse laser light 33 can pass in the thickness direction thereof. The opening direction of the hole 235*a* may be substantially the same as an axis passing through the through hole 24 and the plasma generation region 25 in FIG. 1.

One face of the plate 235 may be provided with the EUV focusing optical system 23*a*.

The other face of the plate 235 may be provided with the plate 225.

The EUV focusing optical system 23*a* may include an EUV focusing mirror 23 and a holder 231.

The holder 231 may hold the EUV focusing mirror 23.

The holder 231 holding the EUV focusing mirror 23 may be fixed to the plate 235.

Regarding the plate 225, the position and the posture thereof may be changeable with respect to the plate 235 by the triaxial stage not illustrated.

The triaxial stage may include an actuator for moving the plate 225 in three axial directions namely the X axis direction, the Y axis direction, and the Z axis direction.

The actuator of the triaxial stage may move the plate 225 with control by the EUV light generation controller 5. Thereby, the position and the posture of the plate 225 may be changed.

The plate 225 may be provided with the laser light focusing optical system 22*a*.

The laser light focusing optical system 22*a* may include a laser light focusing mirror 22, a holder 223, and a holder 224.

The laser light focusing mirror 2.2 may be disposed such that pulse laser light 32 passing through a window 21 provided on the bottom face of the chamber 2 is made incident.

The laser light focusing mirror 22 may include an off-axis parabolic mirror and a plane mirror 222.

The holder 223 may hold the off-axis parabolic minor 221.

The holder 223 holding the off-axis parabolic mirror 221 may be fixed to the plate 225.

The holder 4 may hold the plane mirror 222.

The holder 224 holding the plane mirror 222 may be fixed to the plate 225.

The off-axis parabolic mirror 221 may be disposed to face the window 21 and the plane mirror 222 provided on the bottom face of the chamber 2, respectively.

The plane mirror 222 may be disposed to face the hole 235*a* and the off-axis parabolic mirror 221, respectively.

The positions and the postures of the off-axis parabolic mirror 221 and the plane mirror 222 can be adjusted along with a change of the position and the posture of the plate 225 by the EUV light generation controller 5 via the triaxial stage. Such an adjustment can be made in such a manner that the pulse laser light 33 emitted from the laser light focusing mirror 22 is focused in the plasma generation region 25.

The target recovery unit 28 may be disposed on an extended line in the traveling direction of the target 27 output into the chamber 2.

The laser light travel direction controller 34 may be provided between the window 21 provided on a bottom face of the chamber 2 and a laser device 3.

The laser light travel direction controller 34 may be disposed such that the pulse laser light 31 output from the laser device 3 is made incident.

The laser light travel direction controller 34 may include a high reflective mirror 341 and a high reflective mirror 342.

The high reflective mirror 341 may be disposed to face an emission port of the laser device 3 from which the pulse laser light 31 is output and the high reflective mirror 342, respectively.

The high reflective mirror 342 may be disposed to face the window 21 of the chamber 2 and the high reflective mirror 341, respectively.

The positions and the postures of the high reflective mirror 341 and the high reflective mirror 342 may be adjusted with control by the EUV light generation controller 5. Such an adjustment may be made in such a manner that the pulse laser light 32 that is output light from the laser light travel direction controller 34 passes through the window 21 provided on the bottom face of the chamber 2.

The EUV light generation controller 5 may transmit and receive various types of signals with an exposure device controller 61 provided in the exposure device 6.

For example, the EUV light generation controller 5 may receive, from the exposure device controller 61, an EUV light output command signal representing a control command related to output of the EUV light 252 to the exposure device 6. The EUV light output command signal may include various types of target values such as target output timing of the EUV light 252, a target repetition frequency, and target pulse energy.

The EUV light generation controller 5 may control operation of the respective constituent elements of an EUV light generation system 11, based on the various types of signals transmitted from the exposure device controller 61.

The EUV light generation controller 5 may transmit and receive a control signal with the laser device 3. Thereby, the EUV light generation controller 5 may control operation of the laser device 3.

The EUV light generation controller 5 may transmit and receive control signals with respective actuators that operate the laser light travel direction controller 34 and the laser light focusing optical system 22*a*. Thereby, the EUV light generation controller 5 may regulate the traveling directions and the light focusing positions of beams of the pulse laser light 31 to 33.

The EUV light generation controller 5 may transmit and receive a control signal with the controller 8. Thereby, the EUV light generation controller 5 may indirectly control operation of the respective constituent elements included in the target supply unit 26 and the droplet detector 41.

It should be noted that the hardware configuration of the EUV light generation controller 5 will be described below with use of FIG. 19.

The target supply unit 26 may be a device that generates the target 27 to be supplied to the chamber 2 and outputs it as a droplet 271 to the plasma generation region 25 in the chamber 2. The target supply unit 26 may be a device that outputs the droplet 271 in a so-called continuous jet method.

The material of the target 27 supplied by the target supply unit 26 may be a metallic material. The metallic material of the target 27 may include, but not limited to, tin, terbium, gadolinium, lithium, or a combination of any two or more of them. Preferably, the metallic material of the target 27 may be tin.

The target supply unit 26 may be provided in an end portion of the target supplying path 2*b* of the chamber 2.

The target supply unit 26 may include a tank 261, a nozzle 262, a heater 263, a pressure regulator 264, and a piezo element 265.

The tank 261 may contain the target 27 in a molten state.

The tank 261 may be formed in a hollow cylindrical shape.

A portion, brought into contact with at least the target 27, of the tank 261 in which the target 27 is contained may be made of a material that resists reaction between the target 27 and the portion brought into contact with at least the target 27. The material that resists reaction between the target 27 and the portion brought into contact with at least the target 27 may be any of SiC, $SiO_2$, $Al_2O_3$, molybdenum, tungsten, and tantalum, for example.

The tank 261 may be disposed outside of the end portion of the target supplying path 2*b* of the chamber 2.

The nozzle 262 may output the target 27 contained in the tank 261 into the chamber 2.

The nozzle 262 may be formed in a hollow substantially cylindrical shape.

The nozzle 262 may be provided on the bottom face of the cylindrical tank 261. The nozzle 262 may be formed integrally with the tank 261.

The surface of the nozzle 262, brought into contact with at least the target 27, may be made of a material that resists reaction between the target 27 and the surface brought into contact with at least the target 27. The nozzle 262 may be made of the same material as that of the tank 261.

The nozzle 262 may be disposed inside the end portion of the target supplying path 2*b* of the chamber 2.

On the extended line in the center axis direction of the nozzle 262, the plasma generation region 25 in the chamber 2 may be located.

A tip of the nozzle 262 may be provided with a nozzle hole 262*a* from which the target 27 is output. The nozzle hole 262*a* may be formed in a shape such that the molten target 27 is jetted to the inside of the chamber 2.

In the chamber 2 including the tank 261, the nozzle 262, and the target supplying path 2*b*, the insides thereof may communicate with each other.

The heater 263 may heat the tank 261.

The heater 263 may be fixed to the outer side face of the cylindrical tank 261.

The heater 263 may be connected to a heater power source not illustrated. The heater 263 may heat the tank 261 by the electric power supply from the heater power source. Operation of the heater power source may be controlled by the controller 8.

The pressure regulator 264 may regulate the pressure applied to the target 27 in the tank 261.

The pressure regulator 264 may be connected to the inside of the tank 261.

The pressure regulator 264 may be connected to a gas cylinder not illustrated. The gas cylinder may be filled with inert gas such as helium or argon. The pressure regulator 264 may supply the inert gas in the gas cylinder to the tank 261.

The pressure regulator 264 may be connected to an exhaust pump not illustrated. The pressure regulator 264 may operate the exhaust pump to exhaust the gas in the tank 261.

The pressure regulator 264 may regulate the pressure applied to the target 27 in the tank 261 by supplying gas to the tank 261 or exhausting the gas in the tank 261. Operation of the pressure regulator 264 may be controlled by the controller 8.

The piezo element 265 may vibrate the nozzle 262.

The piezo element 265 may be fixed to the outer side face of the substantially cylindrical nozzle 262.

The piezo element 265 may be connected to a piezo power source not illustrated. The piezo element 265 may be vibrated by the power supplied from the piezo power source. Operation of the piezo power source may be controlled by the controller 8.

The droplet detector 41 may be a sensor that detects the droplet 271 output into the chamber 2.

Specifically, the droplet detector 41 may be a sensor that detects the timing when the droplet 271 passes through a predetermined position P in the chamber 2. The predetermined position P may be a position on the droplet trajectory F between the nozzle 262 of the target supply unit 26 and the plasma generation region 25.

The droplet detector 41 may include a light source unit 410 and a light receiving unit 420.

The light source unit 410 and the light receiving unit 420 may be disposed to face each other over the droplet trajectory F.

The facing direction of the light source unit 410 and the light receiving unit 420 may be substantially orthogonal to the droplet trajectory F.

In FIG. 2, it is described that the facing direction of the light source unit 410 and the light receiving unit 420 is X axis direction, for the sake of convenience. However, the present embodiment is not limited to this. The facing direction of the light source unit 410 and the light receiving unit 420 may be a direction substantially parallel to the XZ plane, or a direction inclined relative to the XZ plane.

The detailed configuration of the light source unit 410 and the light receiving unit 420 will be described below in detail with use of FIGS. 3 and 4.

The controller 8 may transmit and receive various types of signals with the EUV light generation controller 5.

For example, to the controller 8, a target output signal representing a control command related to output of the droplet 271 into the chamber 2 may be input from the EUV light generation controller 5. The target output signal may be a signal that controls operation of the target supply unit 26 such that the droplet 271 is output according to various types of target values included in the EUV light output command signal.

The controller 8 may control operation of the respective constituent elements included in the target supply unit 26 based on the various types of signals from the EUV light generation controller 5.

The controller 8 may also control the timing of outputting laser by the laser device 3 based on the various types of signals from the EUV light generation controller 5.

It should be noted that the hardware configuration of the controller 8 will be described below with use of FIG. 19.

Figure 3:
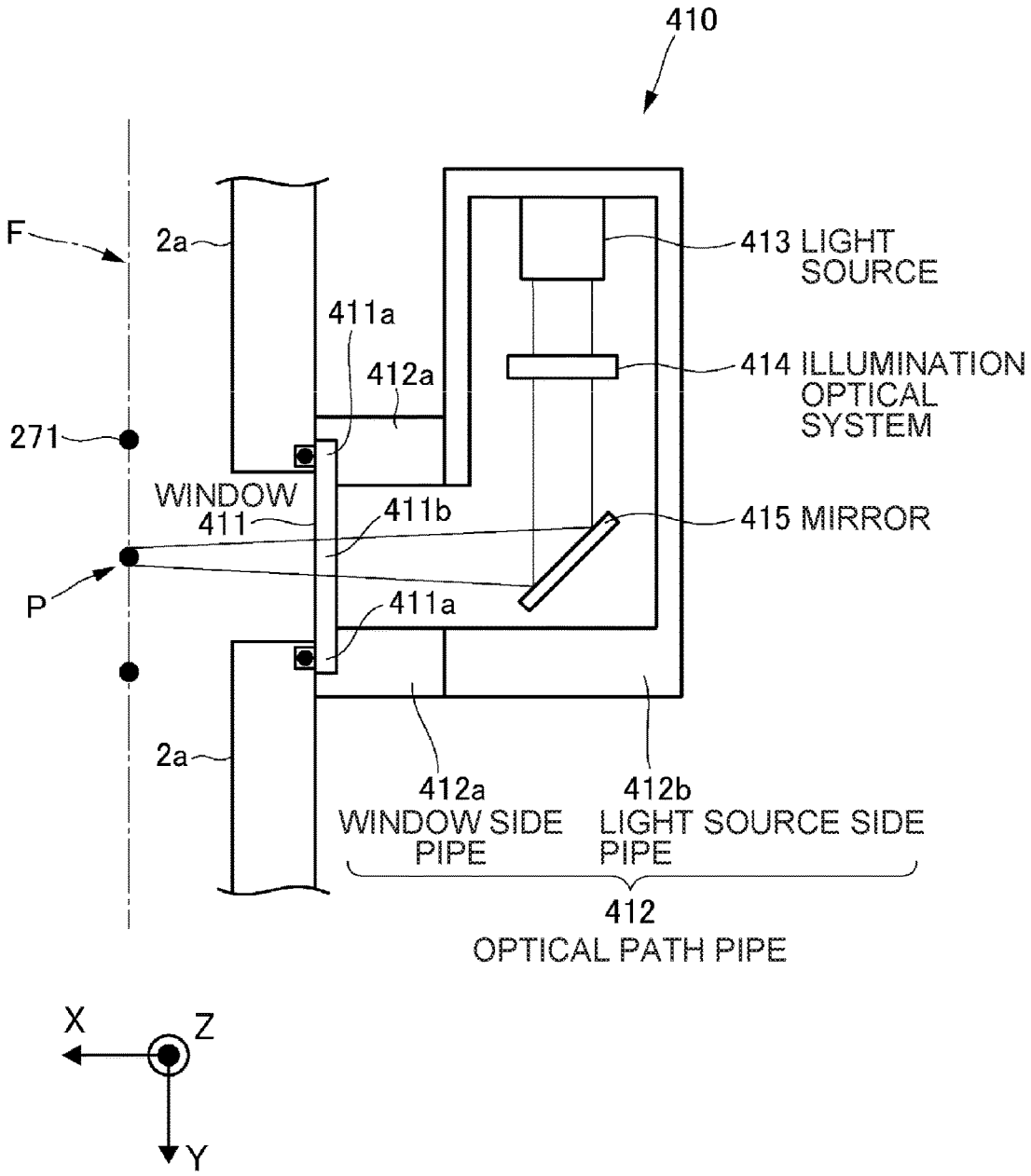
FIG. 3 is a diagram for explaining a detailed configuration of the light source unit illustrated in FIG. 2.

FIG. 3 is a diagram for explaining the detailed configuration of the light source unit 410 illustrated in FIG. 2.

The light source unit 410 may output light to the predetermined position P in the chamber 2.

The light source unit 410 may include the window 411, the optical path pipe 412, the light source 413, an illumination optical system 414, and a mirror 415.

The window 411 may be provided on the wall 2*a* of the chamber 2. The window 411 may be provided on the wall 2*a* of the target supplying path 2*b* that is a part of the chamber 2.

The window 411 may be mounted on the wall 2*a* of the target supplying path 2*b* via a seal member.

The window 411 may be disposed facing the predetermined position P.

The optical path pipe 412 may be a pipe covering the optical path of the light output from the light source 413.

The optical path pipe 412 may be connected to the chamber 2. The optical path pipe 412 may be connected to the wall 2*a* of the chamber 2 via the window 411.

The optical path pipe 412 may be connected to the wall 2*a* on the target supplying path 2*b* that is a part of the chamber 2.

The optical path pipe 412 may include a window side pipe 412*a* and a light source side pipe 412*b*.

The window side pipe 412*a* may be formed such that, with the wall 2*a* on which the window 411 being a base end, a front end thereof extends toward a direction substantially perpendicular to the wall 2*a*. The window side pipe 412*a* may be formed such that the center axis thereof substantially coincides with the center axis of the window 411.

The window side pipe 412*a* may be a window holder for holding the window 411.

The window side pipe 412*a* may hold a peripheral edge 411*a* of the window 411.

The light source side pipe 412*b* may be formed such that, with the front end portion of the window side pipe 412*a* being a base end, a front end thereof extends along the target supplying path 2*b*.

The light source side pipe 412*b* may contain the light source 413, the illumination optical system 414, and the mirror 415 therein.

The light source 413 may be a light source of the light output to the predetermined position P in the chamber 2 via the window 411.

The light source 413 may be disposed apart from the window 411 in the optical path pipe 412. The light source 413 may be disposed on the opposite side of the window 411 in the optical path pipe 412. The light source 413 may be disposed at the front end portion of the light source side pipe 412*b* located opposite to the window 411.

The light source 413 may be a light source such as CW (Continuous Wave) laser outputting single-wavelength continuous laser light, for example. The light source 413 may be a light source such as a lamp that outputs continuous light having multiple wavelengths. Alternatively, the light source 413 may be configured such that these light sources are connected to an optical fiber and disposed outside of the optical path pipe 412, and the head of the optical fiber is disposed in the optical path pipe 412.

Operation of the light source 413 may be controlled by the controller 8.

The illumination optical system 414 may be an optical system including a light focusing lens and the like. The light focusing lens may be a cylindrical lens, for example.

The illumination optical system 414 may be disposed in the light source side pipe 412*b* that is a part of the optical path pipe 412.

The illumination optical system 414 may transmit light output from the light source 413 and focus the light at the predetermined position P via the window 411. The illumination optical system 414 may focus light output from the light source 413 at the predetermined position P such that the focusing position of the light output from the light source 413 substantially coincides with the predetermined position P. The focusing size at the predetermined position P of the light output from the light source 413 may be sufficiently larger than the diameter (e.g., 20 μm) of the droplet 271.

The mirror 415 may be disposed on the optical path of the light output from the light source 413 and passing through the illumination optical system 414. The mirror 415 may be disposed so as to face the window 411 and the illumination optical system 414, respectively.

The mirror 415 may reflect the light passing through the illumination optical system 414 and guide it to the predetermined position P via the window 411.

Figure 4:
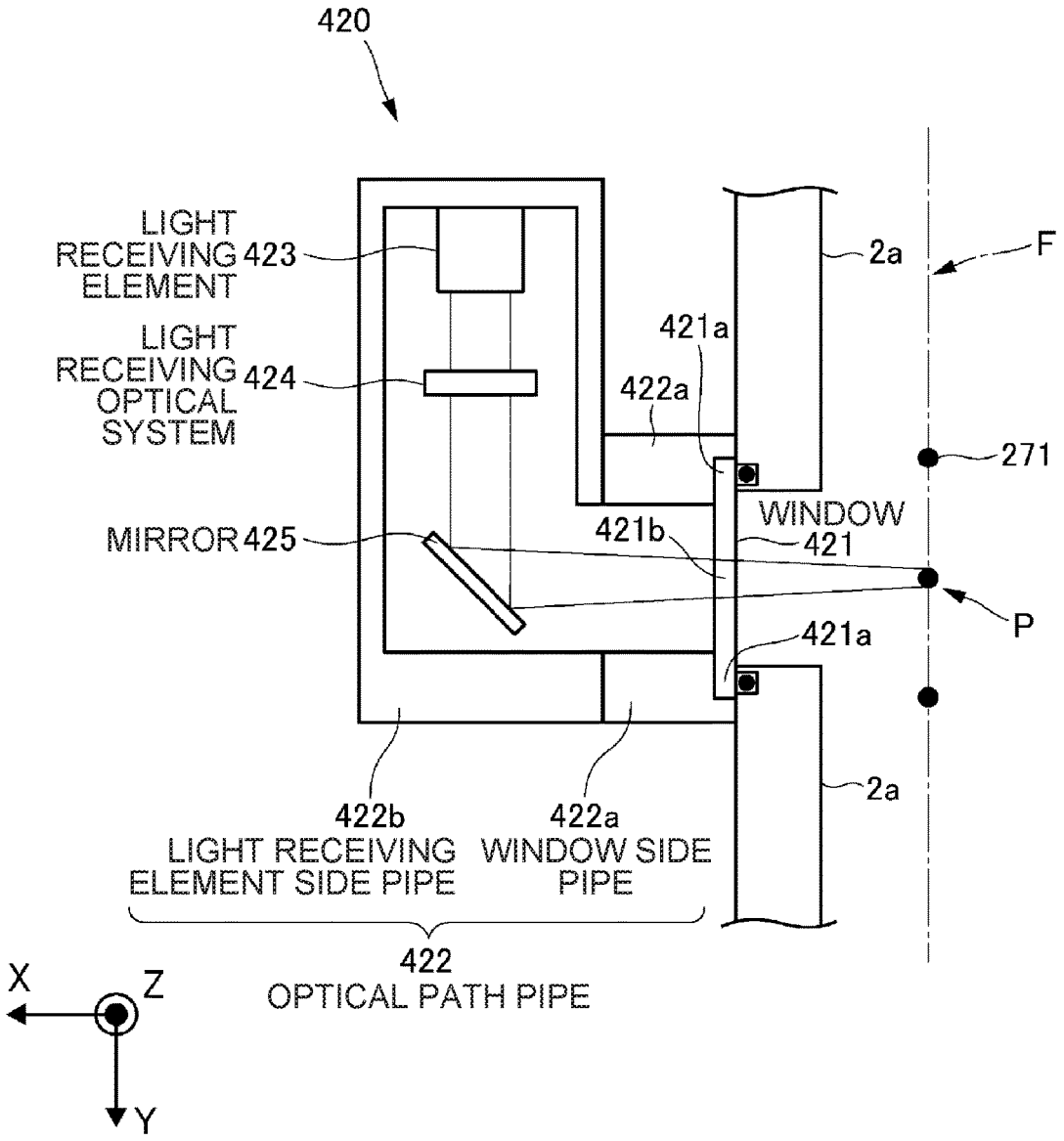
FIG. 4 is a diagram for explaining a detailed configuration of a light receiving unit illustrated in FIG. 2.

FIG. 4 illustrates a diagram for explaining a detailed configuration of the light receiving unit 420 illustrated in FIG. 2.

The light receiving unit 420 may receive light from the inside of the chamber 2.

The light receiving unit 420 may include a window 421, an optical path pipe 422, a light receiving element 423, a light receiving optical system 424, and a mirror 425.

The window 421 may be provided on the wall 2*a* of the chamber 2. The window 421 may be provided on the wall 2*a* of the target supplying path 2*b* that is a part of the chamber 2.

The window 421 may be mounted on the wall 2*a* of the target supplying path 2*b* via a seal member.

The window 421 may be disposed to face the predetermined position P.

The window 421 may be disposed on the optical path of the light output from the light source 413 to the predetermined position P in the chamber 2.

The optical path pipe 422 may be a pipe covering the optical path of the light received by the light receiving element 423.

The optical path pipe 422 may be connected to the chamber 2. The optical path pipe 422 may be connected to the wall 2*a* of the chamber 2 via the window 421.

The optical path pipe 422 may be connected to the wall 2*a* of the target supplying path 2*b* that is a part of the chamber 2.

The optical path pipe 422 may include a window side pipe 422*a* and a light receiving element side pipe 422*b*.

The window side pipe 422*a* may be formed such that, with the wall 2*a* on which the window 421 being a base end, a front end thereof extends toward a direction substantially perpendicular to the wall 2*a*. The window side pipe 422*a* may be formed such that the center axis substantially coincides with the center axis of the window 421.

The window side pipe 422*a* may be a window holder that holds the window 421.

The window side pipe 422*a* may hold a peripheral edge 421*a* of the window 421.

The light receiving element side pipe 422*b* may be formed such that, with the front end portion of the window side pipe 422*a* being a base end, a front end thereof extends along the target supplying path 2*b*.

The light receiving element side pipe 422*b* may contain the light receiving element 423, the light receiving optical system 424, and the minor 425 therein.

The mirror 425 may be disposed on the optical path of the light output from the light source 413 to the predetermined position P of the chamber 2 and passing through the window 421. The mirror 425 may be disposed so as to face the window 421 and the light receiving optical system 424, respectively.

The mirror 425 may reflect the light passing through the window 421 and guide it to the light receiving optical system 424.

The light receiving optical system 424 may be configured of a transfer optical system in which a plurality of lens and the like are combined.

The light receiving optical system 424 may be disposed such that the position of an object in the light receiving optical system 424 substantially coincides with the predetermined position P in the chamber 2. In addition, the light receiving optical system 424 may be disposed such that the position of an image in the light receiving optical system 424 substantially coincides with the position of the light receiving surface of the light receiving element 423.

The light receiving optical system 42.4 may be disposed on the optical path of the light output from the light source 413 to the predetermined position P in the chamber 2 and reflected by the mirror 425.

The light receiving optical system 424 may transfer the image at the predetermined position P of the light output from the light source 413 into the chamber 2, to the light receiving surface of the light receiving element 423.

The light receiving element 423 may be a light receiving element for receiving light from the inside of the chamber 2 via the window 421. Specifically, the light receiving element 423 may be a light receiving element that receives light output from the light source unit 410 to the predetermined position P in the chamber 2.

The light receiving element 423 may be a photodiode, a photodiode array, an avalanche diode, a photomultiplier tube, a multipixel photon counter, or the like, and it may be configured in combination with an image intensifier. The light receiving element 423 may include one or more light receiving surfaces.

The light receiving element 423 may be disposed apart from the window 421 in the optical path pipe 422. The light receiving element 423 may be disposed on the opposite side of the window 421 in the optical path pipe 422. The light receiving element 423 may be disposed at the front end portion of the light receiving element side pipe 422*b* located opposite to the window 421.

The light receiving element 423 may be disposed on the optical path of the light output from the light source 413 to the predetermined position P in the chamber 2 and passing through the light receiving optical system 424.

The light receiving element 423 may output, to the controller 8, a detection signal reflecting the light intensity of an image of the light transferred by the light receiving optical system 424.

With the configuration described above, in the light source unit 410 and the light receiving unit 420, the optical path of the light output from the light source 413 and the optical path of the light received by the light receiving element 423 can be covered with the optical path pipes 412 and 422.

Thereby, in the light source unit 410 and the light receiving unit 420, the light output from the light source 413 can be received appropriately by the light receiving element 423 without deviating from the assumed optical path due to unexpected reflection or the like.

4.2 Operation

Overview of the operation of the EUV light generation device 1 provided with the droplet detector 41 will be described with use of FIG. 5.

Figure 5:
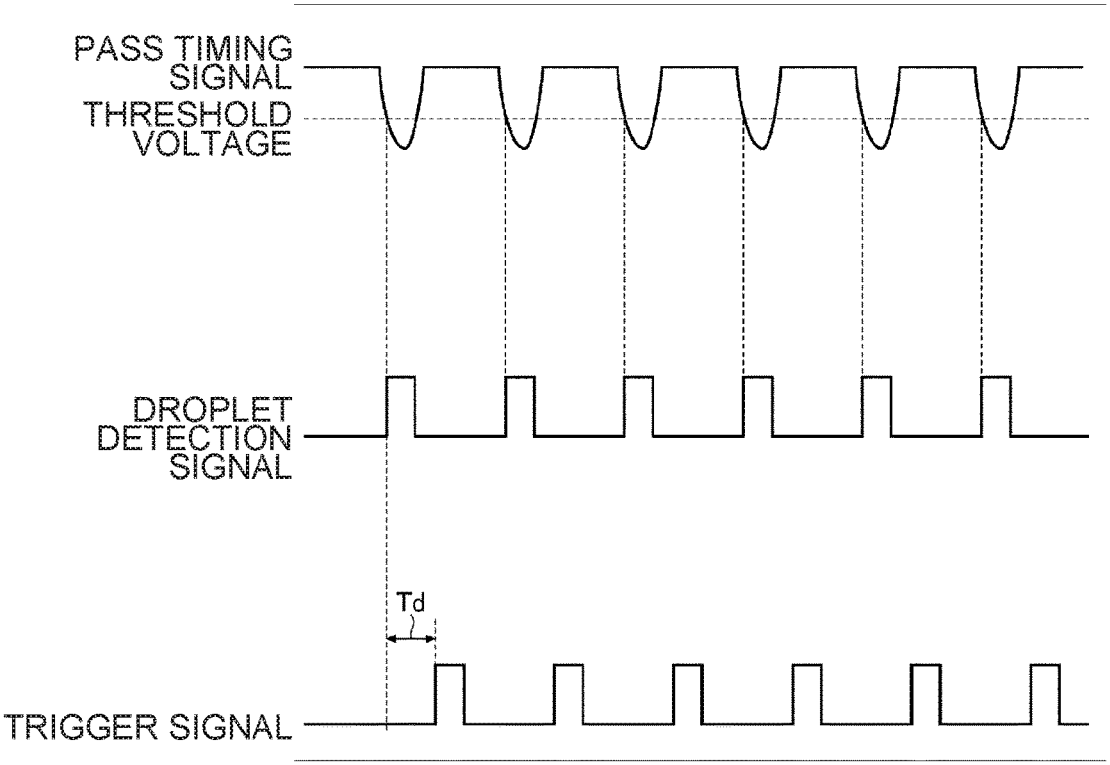
FIG. 5 is a chart for explaining output timing of a laser device controlled by a controller.

FIG. 5 is a chart for explaining output timing of the laser device 3 controlled by the controller 8.

The controller 8 may determine whether or not a target output signal is input from the EUV light generation controller 5.

The target output signal may be a signal representing a control command to cause the target supply unit 26 to supply the target 27 into the chamber 2 as described above.

When a target output signal is input, the controller 8 may perform processing as described below until a target output stop signal is input from the EUV light generation controller 5.

The target output stop signal may be a signal representing a control command to cause the target supply unit 26 to stop supplying of the target 27 into the chamber 2.

The controller 8 may control operation of the heater power source that supplies electric power to the heater 263 to allow the temperature in the tank 261 to be a predetermined target temperature.

The predetermined target temperature may be a temperature within a predetermined range equal to or higher than the melting point of the target 27. When the target 27 is tin, the predetermined target temperature may be in a range from 250° C. to 290° C.

It should be noted that the controller 8 may continuously control the operation of the heater power source such that the temperature in the tank 261 is maintained in a predetermined range equal to or higher than the melting point of the target 27.

The controller 8 may control operation of the pressure regulator 264 such that the pressure applied to the target 27 in the tank 261 becomes a predetermined target pressure.

The predetermined target pressure may be a pressure with which the target 27 in the tank 261 is jetted from the nozzle hole 262*a* at a predetermined velocity. The predetermined velocity may be in a range from 60 m/s to 100 m/s, for example.

The controller 8 may control operation of the piezo power source that supplies electric power to the piezo element 265 such that the piezo element 265 vibrates the nozzle 262 with a predetermined waveform. Specifically, the controller 8 may output a control signal for supplying electric power with a predetermined waveform to the piezo power source.

The predetermined waveform may be a waveform with which the droplet 271 is generated as a predetermined generation frequency. The predetermined generation frequency may be in a range from 50 kHz to 100 kHz, for example.

The piezo element 265 can vibrate the nozzle 262 at a predetermined waveform in response to supply of electric power of a predetermined waveform from the piezo power source. Thereby, a standing wave is applied to the jet-like target 27 jetted from the nozzle 262, and the jet-like target 27 may be separated cyclically. The separated target 27 may form a free interface by the own surface tension to form the droplet 271. As a result, the droplet 271 may be formed at a predetermined generation frequency and output into the chamber 2.

The droplet 271 output into the chamber 2 may travel on the droplet trajectory F and pass through the predetermined position P.

The light source 413 included in the droplet detector 41 may output the light to the predetermined position P in the chamber 2. The light receiving element 423 included in the droplet detector 41 may receive the light output from the light source 413.

In the case where the droplet 271 travelling on the droplet trajectory F passes through the predetermined position P, the light source 413 may output the light toward the droplet 271 passing through the predetermined position P. The light output toward the droplet 271 may travel toward the light receiving element 423. At that time, part of the light traveling toward the light receiving element 423 may be shielded by the droplet 271.

As such, when the droplet 271 passes through the predetermined position P, a part of an image at the predetermined position P of the light output from the light source 413 may be transferred to the light receiving surface of the light receiving element 423 as a shadow image of the droplet 271 passing through the predetermined position P. In other words, when the droplet 271 passes through the predetermined position P, the light receiving element 423 can receive light not shielded by the droplet 271 and passing through the periphery thereof, of the light output from the light source 413 and radiated to the droplet 271.

Accordingly, when the droplet 271 passes through the predetermined position P, the light intensity of the light received by the light receiving element 423 may be reduced significantly compared with the case where the droplet 271 does not pass through the predetermined position P.

The light receiving element 423 may convert the light intensity of the received light into a voltage value to generate a detection signal corresponding to the change in the light intensity and output it to the controller 8.

It should be noted that the light intensity of the light received h the light receiving element 423 is also referred to as light receiving intensity in the light receiving element 423.

A detection signal corresponding to the change in the light intensity generated by the light receiving element 423 is also referred to as a pass timing signal.

To the controller 8, a pass timing signal output from the light receiving element 423 of the droplet detector 41 may be input.

When the input pass timing signal shows a value lower than a predetermined threshold voltage beyond the threshold voltage, the controller 8 may determine that the droplet 271 passes through the predetermined position P. In that case, the controller 8 may generate a droplet detection signal at the timing when the pass timing signal exceeds the predetermined threshold voltage, as illustrated in FIG. 5.

The predetermined threshold voltage may be set in advance based on a range of voltage values that can be taken by the pass timing signal when the droplet 271 passes through the predetermined position P.

The droplet detection signal may be a signal representing that the droplet 271 passing through the predetermined position P is detected.

As illustrated in FIG. 5, the controller 8 may output a trigger signal to the laser device 3 at timing delayed by a delay time Td from the timing of generating the droplet detection signal.

A trigger signal may be a signal gives a trigger to the laser device 3 to output the pulse laser light 31.

The delay time Td may be a delay time for making the timing when the pulse laser light 33 is focused on the plasma generation region 25 substantially coincide with the timing when the droplet 271 reaches the plasma generation region 25.

When a trigger signal is input, the laser device 3 may output the pulse laser light 31. The pulse laser light 31 output from the laser device 3 may be introduced into the chamber 2 as the pulse laser light 32, via the laser light travel direction controller 34 and the window 21.

The pulse laser light 32 introduced into the chamber 2 may be focused by the laser light focusing optical system 22*a*, and guided to the plasma generation region 25 as the pulse laser light 33. The pulse laser light 33 may be guided to the plasma generation region 25 at the timing when the droplet 271 reaches the plasma generation region 25.

The pulse laser light 33 guided to the plasma generation region 25 may irradiate the droplet 271 that has reached the plasma generation region 25. The droplet 271 irradiated with the pulse laser light 33 may be made into plasma and radiate plasma light including EUV light 251.

In this way, the droplet detector 41 may detect the timing when the droplet 271 output into the chamber 2 passes through the predetermined position P, and output a pass timing signal.

Then, the controller 8 may output a trigger signal to the laser device 3 in synchronization with a change of the pass timing signal output from the droplet detector 41 to thereby control the timing of outputting laser by the laser device 3. That is, the controller 8 may control the output timing of the pulse laser light 31 from the laser device 3 based on the timing when the droplet 271 passes through the predetermined position P.

5. Problem

A problem of the EUV light generation device 1 provided with the droplet detector 41 will be described with use of FIGS. 6 to 9B.

Figure 6:
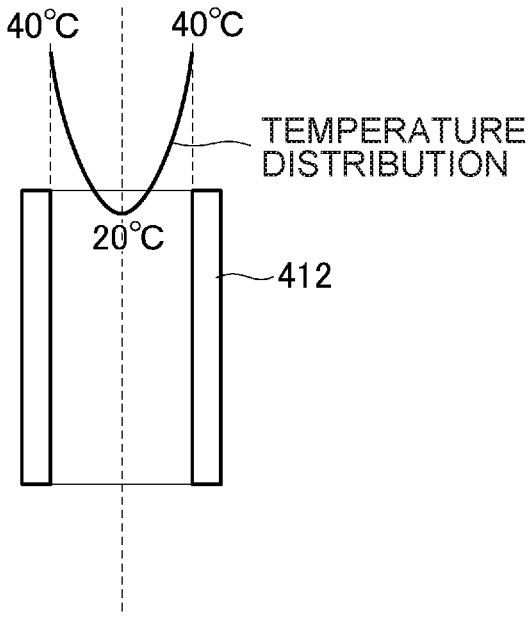
FIG. 6 is a diagram for explaining temperature distribution caused in an optical path pipe.
Figure 7A:
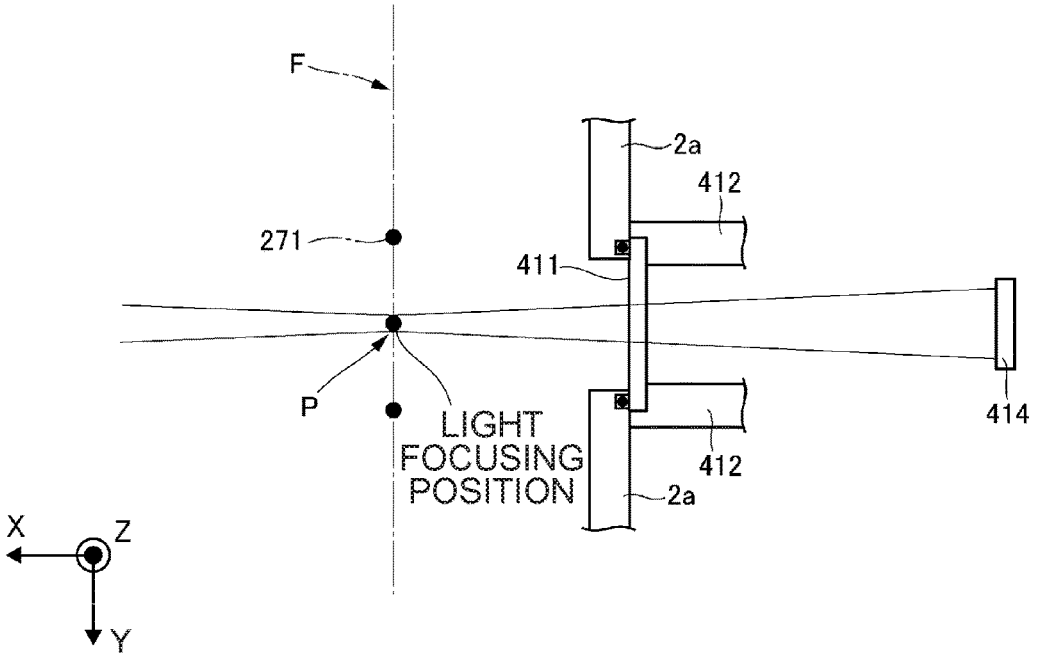
FIGS. 7A and 7B are diagrams for explaining that a focusing position of light output from a light source is changed along with formation of a thermal lens in an optical path pipe.
Figure 7B:
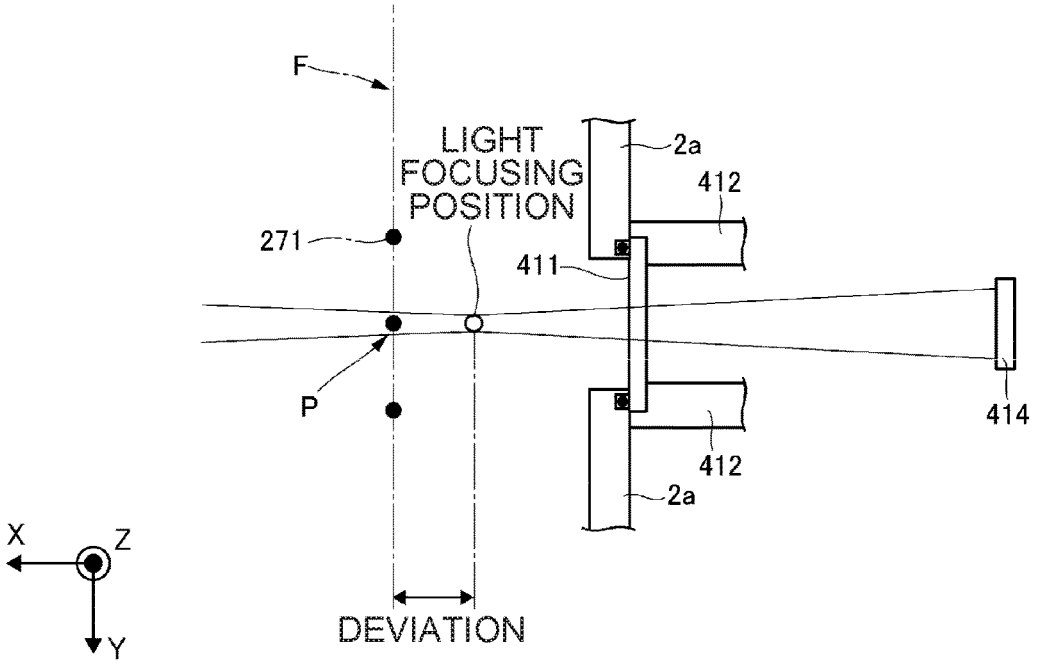
Figure 8A:
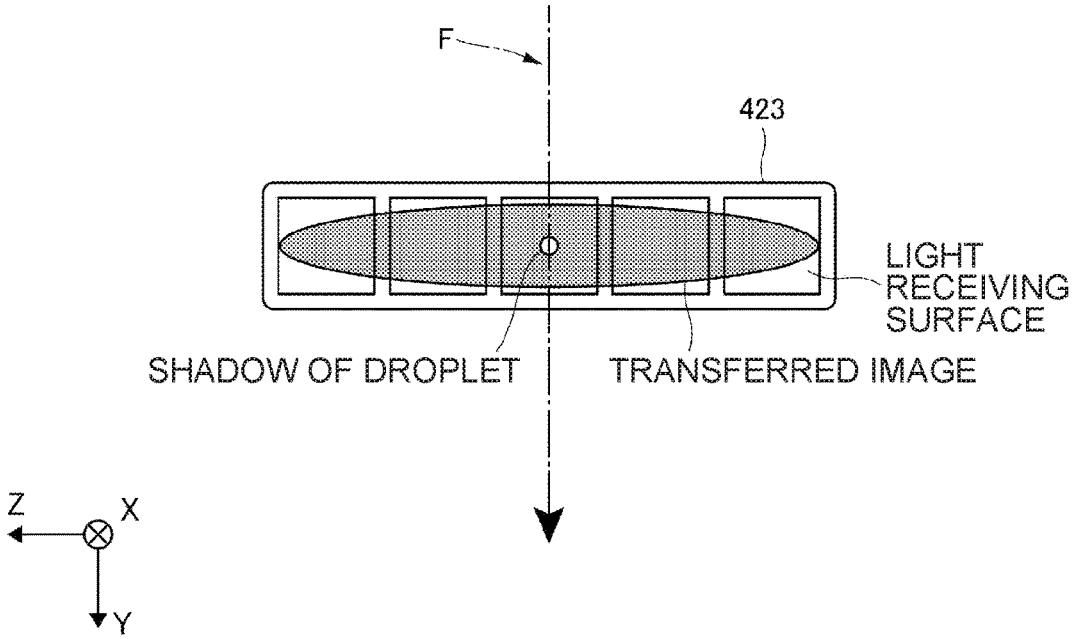
FIGS. 8A and 8B are diagrams for explaining that an image of light transferred to a light receiving surface of the light receiving element is changed along with a change of a focusing position of light output from the light source respectively illustrated in FIGS. 74 and 7B.
Figure 8B:
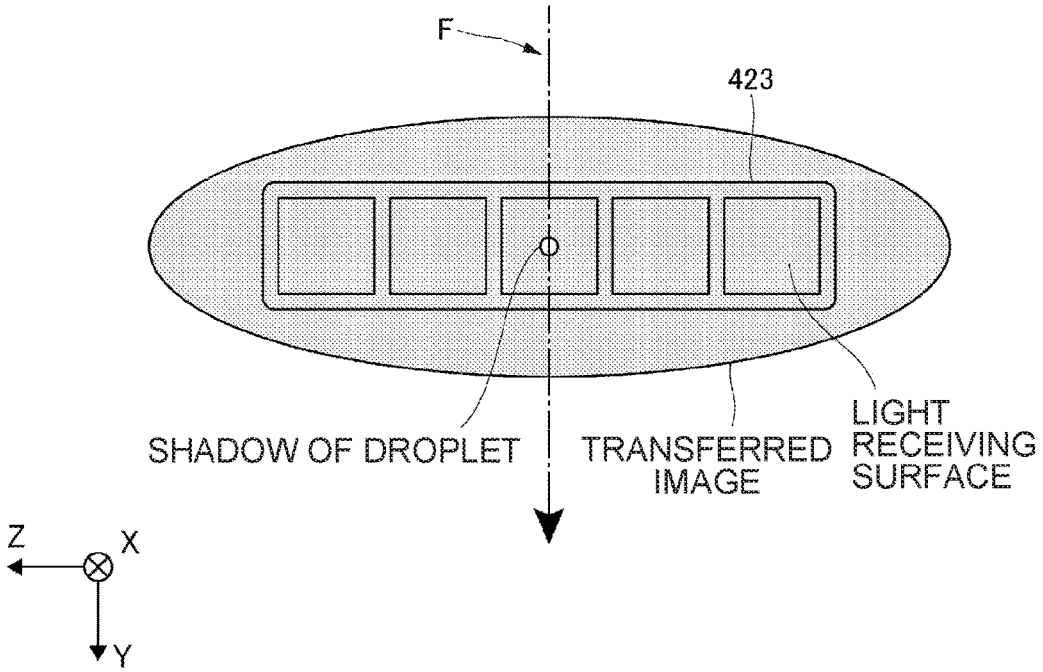
Figure 9A:
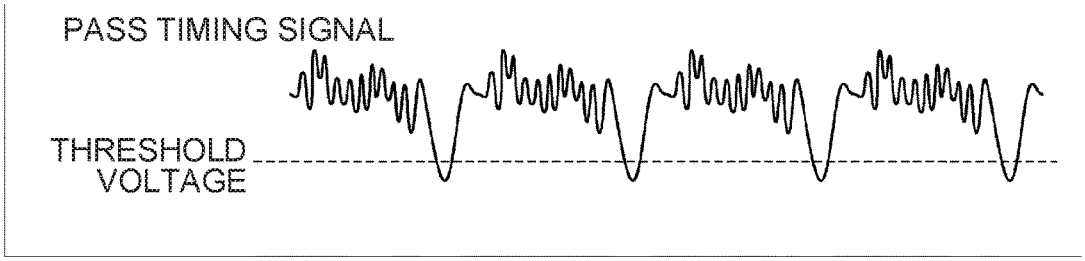
FIGS. 9A and 9B are charts for explaining that a pass timing signal output from the light receiving element is changed along with a change of an image of light transferred to the light receiving surface of the light receiving element respectively illustrated in FIGS. 8A and 8B.
Figure 9B:
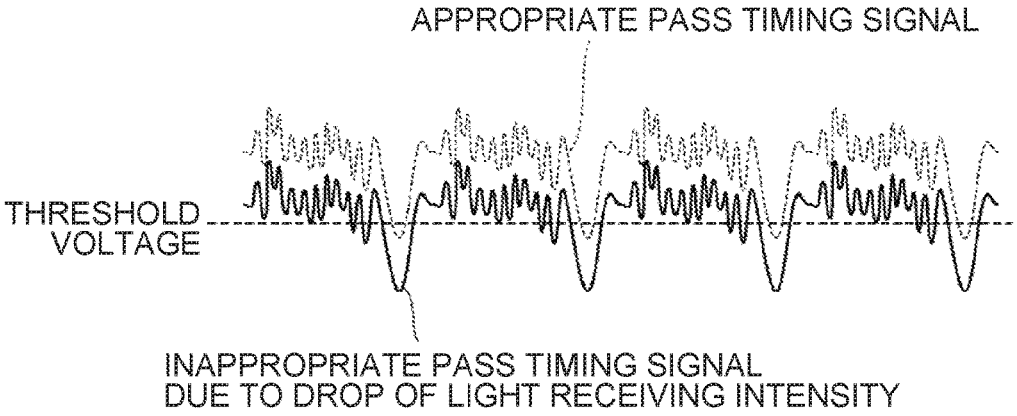

FIG. 6 is a diagram for explaining temperature distribution caused in the optical path pipe 412. FIGS. 7A and 7B are diagrams for explaining that the light focusing position of the light output from the light source 413 is changed along with formation of a thermal lens in the optical path pipe 412. FIGS. 8A and 8B are diagrams for explaining that an image of light transferred to the light receiving surface of the light receiving element 423 is changed along with a change of the light focusing position of the light output from the light source 413 respectively illustrated in FIGS. 7A and 7B. FIGS. 9A and 9B are charts for explaining that a pass timing signal output from the light receiving element 423 is changed along with a change of an image of the light transferred to the light receiving surface of the light receiving element 423 respectively illustrated in FIGS. 8A and 8B.

The controller 8 of the EUV light generation device 1 can control the timing of outputting laser by the laser device 3, by outputting a trigger signal to the laser device 3 in synchronization with a change of the pass timing signal output from the droplet detector 41, as described above.

Thereby, the droplet 271 that has reached the plasma generation region 25 can be irradiated with the pulse laser light 33, and the droplet 271 can be made into plasma and radiate plasma light including the EUV light 251.

At that time, the pulse laser light 33 radiated to the droplet 271 may be scattered and irradiate the wall 2*a* of the chamber 2. In addition, part of the plasma light radiated from the plasma may not be reflected selectively by the EUV focusing mirror 23 and may irradiate the wall 2*a* of the chamber 2.

The wall 2*a* of the chamber 2 may be heated by irradiation with the scattered light of the pulse laser light 33 and the plasma light. The heat generated in the wall 2*a* of the chamber 2 may be transmitted to the wall of the optical path pipe 412 connected to the wall 2*a*. The temperature of the wall of the optical path pipe 412 may rise.

Then, the temperature of the gas near the inner wall of the optical path pipe 412 may rise, compared to the gas near the center axis of the optical path pipe 412, as illustrated in FIG. 6. Accordingly, a significant difference may be caused in the refractive index between the gas near the inner wall of the optical path pipe 412 and the gas near the center axis of the optical path pipe 412. That is, the gas in the optical path pipe 412 may generate refractive index distribution along with the gas temperature distribution to thereby form a thermal lens.

When a thermal lens is formed in the optical path pipe 412, the light focusing position of the light output from the light source 413 may change, as illustrated in FIGS. 7A and 7B.

That is, when a thermal lens is not formed in the optical path pipe 412, the light focusing position of the light output from the light source 413 may substantially coincide with the predetermined position P by the illumination optical system 414, as illustrated in FIG. 7A.

On the other hand, when a thermal lens is formed in the optical path pipe 412, the light focusing position of the light output from the light source 413 may be deviated from the predetermined position P by the illumination optical system 414, as illustrated in FIG. 7B.

For example, it is assumed that a distance from the illumination optical system 414 to the predetermined position P is 600 mm, a distance from the illumination optical system 414 to the wall 2*a* of the chamber 2 is 200 mm, an inner diameter of the optical path pipe 412 is 30 mm, and a beam diameter of the light output from the light source 413 is 10 mm. It is also assumed that the gas temperature near the inner wall of the optical path pipe 412 is 40° C., the gas temperature near the center axis of the optical path pipe 412 is 20° C., and the gas temperature distribution in the optical path pipe 412 is proportional to the square of the distance in the diameter direction with respect to the center axis of the optical path pipe 412. Moreover, it is assumed that a thermal lens is formed in the optical path pipe 412 from the wall 2*a* of the chamber 2 up to a position of 100 mm toward the illumination optical system 414 side. In this case, the light focusing position of the light output from the light source 413 may be deviated to the illumination optical system 414 side by 2.2 mm from the predetermined position P.

When the light focusing position of the light output from the light source 413 changes along with formation of a thermal lens in the optical path pipe 412, an image of the light transferred to the light receiving surface of the light receiving element 423 may change, as illustrated in FIGS. 8A and 8B.

That is, when the light focusing position of the light output from the light source 413 substantially coincides with the predetermined position P, an image at the predetermined position P of the light output from the light source 413 may be appropriately transferred to the light receiving surface so as to be fit within the light receiving surface of the light receiving element 423, as illustrated in FIG. 8A.

Meanwhile, when the light focusing position of the light output from the light source 413 is deviated from the predetermined position P, the image at the predetermined position P of the light output from the light source 413 may be transferred to the light receiving surface as a large image not fit in the light receiving surface of the light receiving element 423, as illustrated in FIG. 8B.

When the image of the light to be transferred to the light receiving surface of the light receiving element 423 changes along with a change of the light focusing position of the light output from the light source 413, a pass timing signal output from the light receiving element 423 may vary, as illustrated in FIGS. 9A and 9B.

That is, in the case where the image at the predetermined position P of the light output from the light source 413 is appropriately transferred to the light receiving surface of the light receiving element 423, the image at the predetermined position P of the light output from the light source 413 may be detected at an appropriate light receiving intensity in the light receiving element 423. Accordingly, the light receiving element 423 can output an appropriate pass timing signal as illustrated in FIG. 9A.

It should be noted that an appropriate pass timing signal may be a pass timing signal that varies while keeping a sufficiently large voltage with respect to a predetermined threshold voltage at a level such that the noise included in the pass timing signal does not become lower than the threshold voltage beyond the threshold voltage.

On the other hand, when the image at the predetermined position P of the light output from the light source 413 is transferred as a large image not fit in the light receiving surface of the light receiving element 423, the light receiving intensity in the light receiving element 423 may be lowered as a whole than that illustrated in FIG. 8A. As such, the light receiving element 423 may not output an appropriate pass timing signal, as illustrated in FIG. 9B. This means that along with a drop of the light receiving intensity in the light receiving element 423, there is a case where a pass timing signal does not secure a voltage that is large enough with respect to a predetermined threshold voltage so that the noise included in the pass timing signal shows a value lower than the threshold voltage beyond the threshold voltage.

Thereby, the controller 8 may generate a droplet detection signal and a trigger signal at wrong timing regardless of the fact that the droplet 271 does not pass through the predetermined position P. Then, the controller 8 may output a trigger signal to the laser device 3 at wrong timing.

Consequently, the laser device 3 may output the pulse laser light 31 at wrong timing and unnecessary pulse laser light 33 may be introduced into the chamber 2.

Accordingly, a technique capable of controlling the output timing of the pulse laser light 31 from the laser device 3 with high accuracy, by improving the detection accuracy of the droplet detector 41 that detects the pass timing of the droplet 271 at the predetermined position P in the chamber 2, is desired.

6. EUV Light Generation Device of First Embodiment

An EUV light generation device 1 of a first embodiment will be described with use of FIGS. 10 and 11.

In the EUV light generation device 1 of the first embodiment, the configuration of a light source unit 410 included in a droplet detector 41 may be mainly different from that of the EUV light generation device 1 illustrated in FIGS. 2 to 5. Further, the EUV light generation device 1 of the first embodiment may have a configuration in which a gas supply unit 71 is added to the EUV light generation device 1 illustrated in FIGS. 2 to 5.

Regarding the configuration of the EUV light generation device 1 of the first embodiment, description of the configuration that is the same as the configuration of the EUV light generation device 1 illustrated in FIGS. 2 to 5 is omitted.

6.1 Configuration

Figure 10:
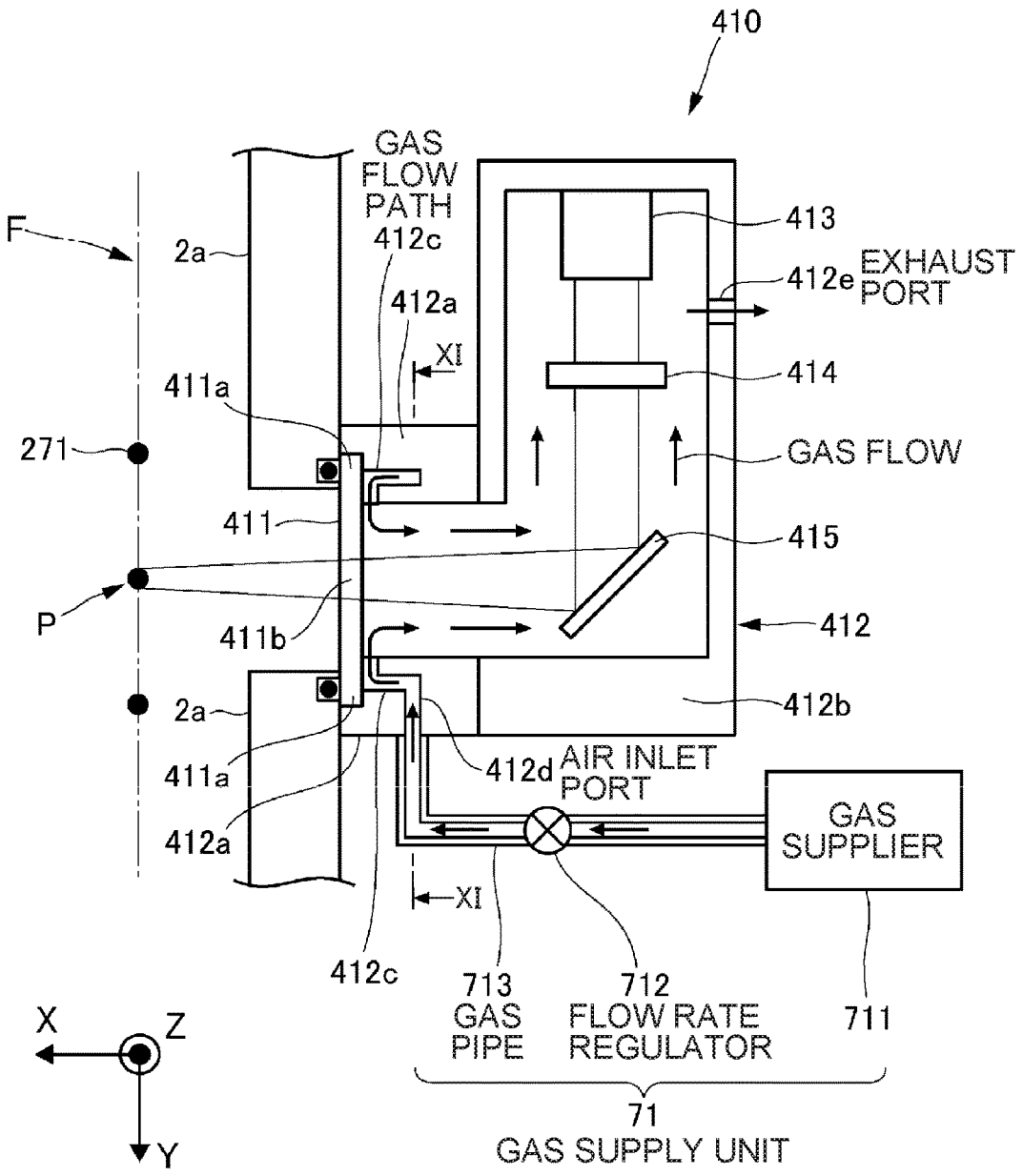
FIG. 10 is a diagram for explaining a configuration of a gas supply unit and a light source unit according to a first embodiment.

FIG. 10 is a diagram for explaining configurations of the gas supply unit 71 and the light source unit 410 according to the first embodiment. FIG. 11 is a cross-sectional view taken along the line XI-XI illustrated in FIG. 10.

Figure 11:
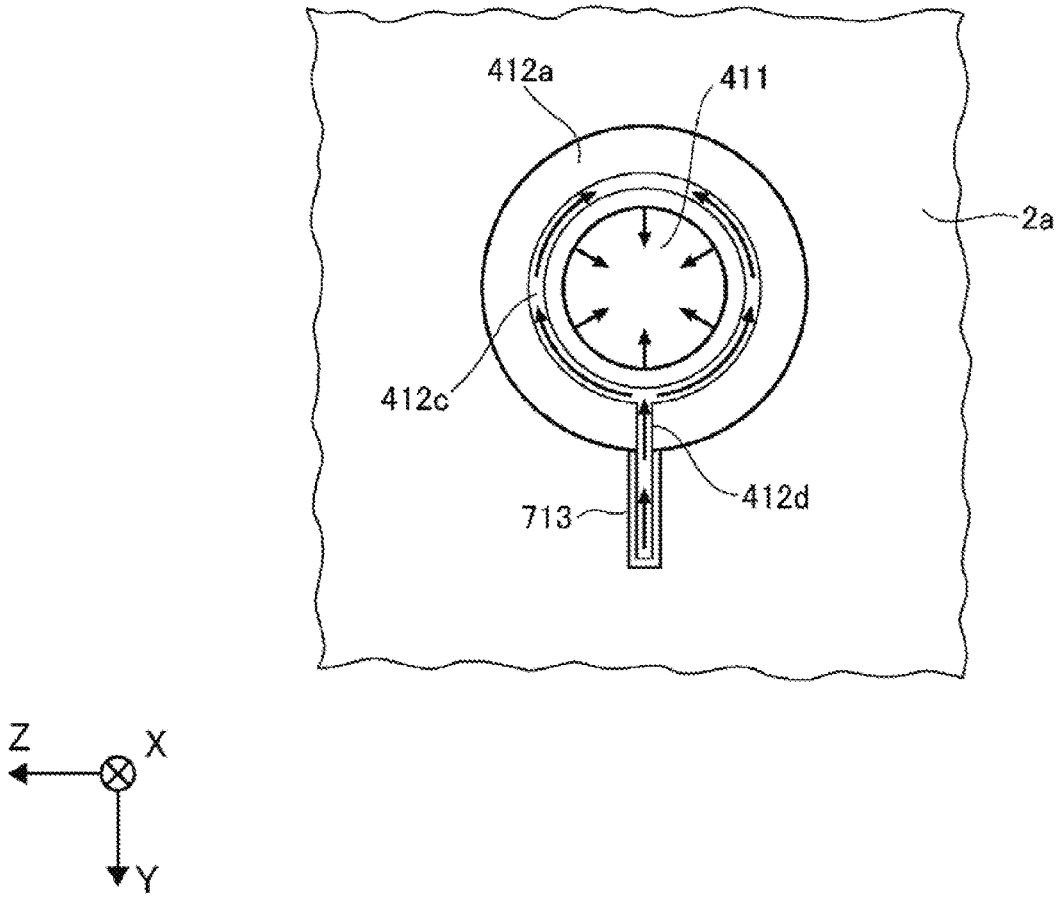
FIG. 11 is a cross-sectional view taken along a line XI-XI illustrated in FIG. 10.

In the light source unit 410 illustrated in FIGS. 10 and 11, the configuration of an optical path pipe 412 may be different from that of the light source unit 410 illustrated in FIGS. 2 and 3.

The gas supply unit 71 may supply gas into the optical path pipe 412.

The gas supply unit 71 may include a gas supplier 711, a flow rate regulator 712, and a gas pipe 713.

The gas supplier 711 may be a device that supplies gas into the optical path pipe 412. The gas supplied into the optical path pipe 412 may be clean dry air (CDA). The gas supplier 711 may have a function of generating CDA.

The CDA supplied by the gas supplier 711 may be dry air having a dew point of −70° C. or lower. The CDA may have a characteristic of having less steep temperature change and no risk of suffocating workers.

The gas supplier 711 may be disposed outside of the chamber 2 and the optical path pipe 412.

The gas supplier 711 may be connected to the optical path pipe 412 via the gas pipe 713.

Operation of the gas supplier 711 may be controlled by the controller 8.

The flow rate regulator 712 may be a device that regulates the flow rate of the gas supplied from the gas supplier 711 into the optical path pipe 412.

The flow rate regulator 712 may be a valve or an orifice.

The flow rate regulator 712 may be provided on the gas pipe 713. The flow rate regulator 712 may regulate the flow rate of the gas supplied from the gas supplier 711 into the optical path pipe 412 by regulating the flow of gas flowing through the gas pipe 713.

Operation of the flow rate regulator 712 may be controlled by the controller 8.

The optical path pipe 412 may include a gas flow path 412*c*, an air inlet port 412*d*, and an exhaust port 412*e*, in addition to the window side pipe 412*a* and the light source side pipe 412*b* illustrated in FIG. 3.

The air inlet port 412*d* may be an inlet port for supplying gas from the gas supplier 711 into the optical path pipe 412.

The air inlet port 412*d* may be provided on the wall of the window side pipe 412*a* of the optical path pipe 412. The air inlet port 412*d* may be provided at an end portion of the window 411 side of the wall of the window side pipe 412*a*.

The air inlet port 412*d* may be configured of a through hole penetrating the wall of the window side pipe 412*a*.

The air inlet port 412*d* may be connected to the gas pipe 713.

The gas flow path 412*c* may be a channel through which the gas flowing from the air inlet port 412*d* passes the wall of the optical path pipe 412.

The gas flow path 412*c* may be provided inside the wall of the window side pipe 412*a*.

The gas flow path 412*c* may be provided inside the wall of the window side pipe 412*a* and in the vicinity of the air inlet port 412*d*.

The gas flow path 412*c* may be formed along the circumferential direction of the inner wall surface of the window side pipe 412*a*. The gas flow path 412*c* may be formed along the peripheral edge 411*a* of the window 411 held by the window side pipe 412*a*.

The gas flow path 412*c* may be formed such that a surface on the inner wall surface side of the window side pipe 412*a* is opened over the whole circumference of the inner wall surface to communicate with the inner space of the window side pipe 412*a*. This opening may be opened from the peripheral edge 411*a* over the whole circumference of the window 411 along a direction toward a center portion 411*b*.

In the gas flow path 412*c*, a through hole penetrating from a portion of a surface on the inner wall surface side of the window side pipe 412*a* toward a portion of the outer wall surface of the window side pipe 412*a* may be formed to communicate with the outside of the window side pipe 412*a*. The through hole may constitute the air inlet port 412*d*.

The exhaust port 412*e* may be an outlet port for discharging the gas in the optical path pipe 412 to the outside of the optical path pipe 412.

The exhaust port 412*e* may be provided on the wall of the light source side pipe 412*b* in the optical path pipe 412. The exhaust port 412*e* may be provided in an end portion on the light source 413 side of the wall of the light source side pipe 412*b*.

The exhaust port 412*e* may be configured of a through hole penetrating the wall of the light source side pipe 412*b*.

The other part of the configuration of the light source unit 410 according to the first embodiment may be the same as that of the light source unit 410 illustrated in FIGS. 2 and 3.

The other part of the configuration of the EUV light generation device 1 according to the first embodiment may be the same as that of the EUV light generation device 1 illustrated in FIGS. 2 to 5.

6.2 Operation

Operation of the EUV light generation device 1 according to the first embodiment will be described.

Regarding the operation of the EUV light generation device 1 of the first embodiment, description of the operation that is the same as that of the EUV light generation device 1 illustrated in FIGS. 2 to 5 is omitted.

The gas supplier 711 may allow the gas for being supplied into the optical path pipe 412 to flow through the gas pipe 713 with control by the controller 8.

The flow rate regulator 712 may regulate the flow rate of the gas flowing through the gas pipe 713 such that the gas of a predetermined flow rate is supplied into the optical path pipe 412, with control by the controller 8. The predetermined flow rate may be about 10 L/min, for example.

The gas regulated to have a predetermined flow rate may enter from the gas pipe 713 to the air inlet port 412*d*. The gas entering the air inlet port 412*d* may flow through the gas flow path 412*c* to enter the window side pipe 412*a* of the optical path pipe 412.

At this time, the gas entering the window side pipe 412*a* may flow from the peripheral edge 411*a* over the whole circumference of the window 411 toward the center portion 411*b*. In other words, the gas supply unit 71 can supply gas into the optical path pipe 412 such that the gas flows from the peripheral edge 411*a* over the whole circumference of the window 411 toward the center portion 411*b*.

The gas flowing toward the center portion 411*b* of the window 411 may flow from the window side pipe 412*a* toward the light source side pipe 412*b*, and may be discharged to the outside from the exhaust port 412*e* provided in the light source side pipe 412*b*.

In general, the window side pipe 412*a* in contact with the wall 2*a* of the chamber 2 that can be heated by the scattered light of the pulse laser light 33 and the plasma light is likely to become a higher temperature than the light source side pipe 412*b* not in contact with the wall 2*a*.

That is, the gas flowing from the window side pipe 412*a* toward the light source side pipe 412*b* means that the gas flows from the higher temperature side toward the lower temperature side of the optical path pipe 412. In other words, the gas supply unit 71 can supply gas into the optical path pipe 412 such that the gas flows from the higher temperature side toward the lower temperature side of the optical path pipe 412.

The other part of the operation of the light source unit 410 according to the first embodiment may be the same as that of the light source unit 410 illustrated in FIGS. 2 and 3.

The other part of the operation of the EUV light generation device 1 according to the first embodiment may be the same as that of the EUV light generation device 1 illustrated in FIGS. 2 to 5.

6.3 Effect

The gas supply unit 71 may supply gas into the optical path pipe 412 to generate a gas flow in the optical path pipe 412, to thereby make the temperature distribution in the optical path pipe 412 substantially uniform.

Therefore, the gas supply unit 71 may suppress generation of refractive index distribution in the optical path pipe 412 and suppress formation of a thermal lens in the optical path pipe 412.

Accordingly, the gas supply unit 71 may suppress deviation of the focusing position of the light output from the light source 413 from the predetermined position P in the chamber 2.

Thereby, the droplet detector 41 according to the first embodiment can output an appropriate pass timing signal from the light receiving element 423. Accordingly, the droplet detector 41 can detect the pass timing of the droplet 271 at the predetermined position P with high accuracy.

As a result, the EUV light generation device 1 of the first embodiment can suppress output of a trigger signal to the laser device 3 at wrong timing, and can control the output timing of the pulse laser light 31 from the laser device 3 with high accuracy.

Further, the gas supply unit 71 may supply gas into the optical path pipe 412 such that the gas flows from the peripheral edge 411*a* to the center portion 411*b* of the window 411.

Thereby, in the EUV light generation device 1 of the first embodiment, the temperature distribution of the gas in the optical path pipe 412 can be made further uniform and the refractive index distribution in the optical path pipe 412 can be further suppressed. Therefore, deviation of the light focusing position of the light output from the light source 413 can be further suppressed.

Consequently, in the EUV light generation device 1 of the first embodiment, the pass timing of the droplet 271 can be detected with higher accuracy, and the output timing of the pulse laser light 31 can be controlled with higher accuracy.

In addition, the gas supply unit 71 may supply gas into the optical path pipe 412 such that the gas flows from the high temperature side toward the low temperature side of the optical path pipe 412.

Thereby, in the EUV light generation device 1 of the first embodiment, the temperature distribution of the gas in the optical path pipe 412 can be made even more uniform and the refractive index distribution in the optical path pipe 412 can be even more suppressed. Therefore, deviation of the light focusing position of the light output from the light source 413 can be even more suppressed.

Consequently, in the EUV light generation device 1 of the first embodiment, the pass timing of the droplet 271 can be detected with much higher accuracy, and the output timing of the pulse laser light 31 can be controlled with much higher accuracy.

6.4 Modification 1 of First Embodiment

An EUV light generation device 1 of Modification 1 of the first embodiment will be described with use of FIG. 12.

In the EUV light generation device 1 of Modification 1 of the first embodiment, the configuration of the gas flow path 412*c* provided on the wall of the optical path pipe 412 may be different from that of the EUV light generation device 1 of the first embodiment.

Regarding the configuration of the EUV light generation device 1 according to Modification 1 of the first embodiment, description of the configuration that is the same as that of the EUV light generation device 1 of the first embodiment is omitted.

Figure 12:
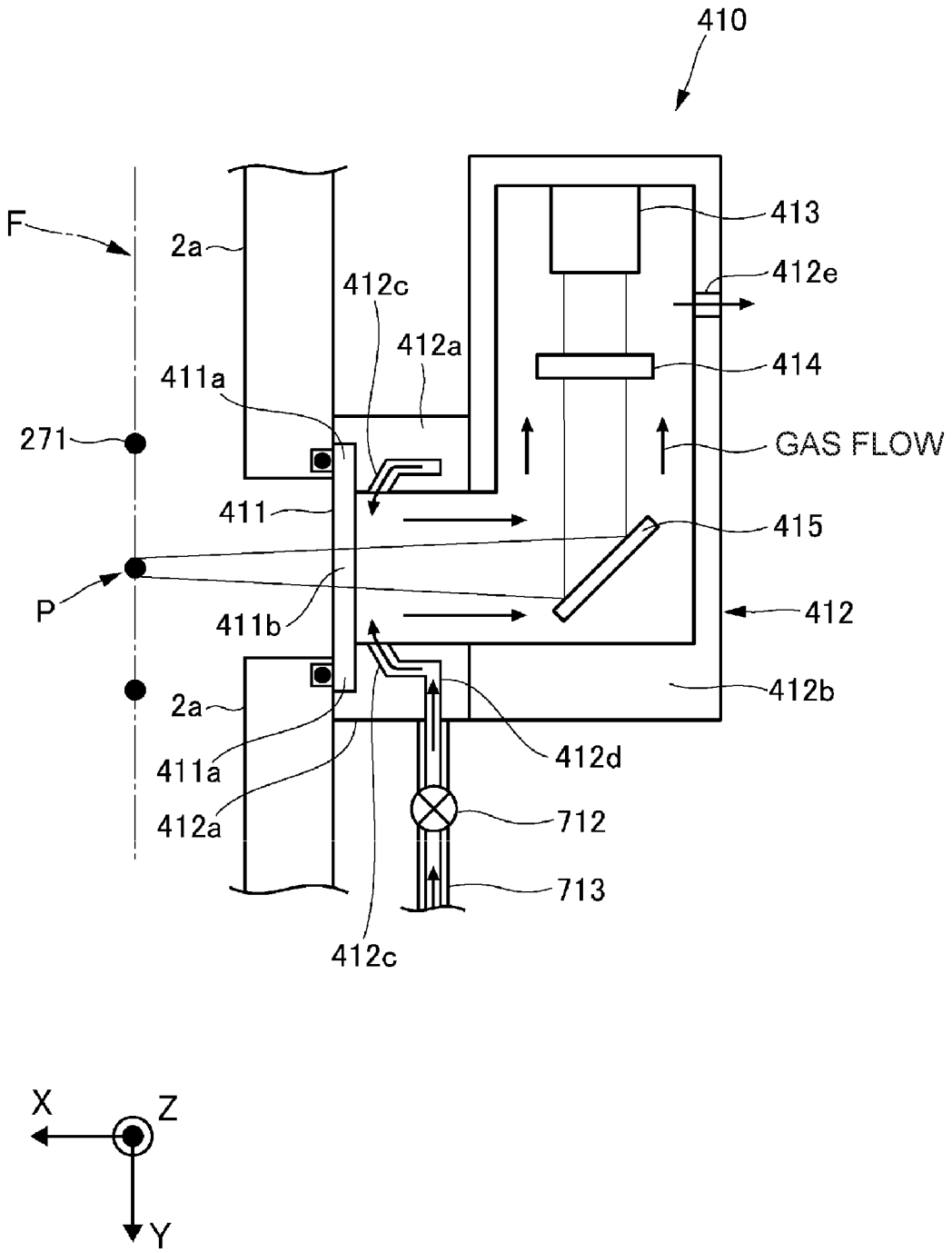
FIG. 12 is a diagram for explaining a light source unit according to Modification 1 of the first embodiment.

FIG. 12 is a diagram for explaining the light source unit 410 according to Modification 1 of the first embodiment.

The gas flow path 412*c* illustrated in FIG. 12 may be formed such that a surface on the inner wall surface side of the window side pipe 412*a* is opened over the whole circumference of the inner wall surface, similar to the gas flow path 412*c* illustrated in FIGS. 10 and 11, and may communicate with the inner space of the window side pipe 412*a*.

However, in the gas flow path 412*c* illustrated in FIG. 12, the opening may be opened to a direction from the peripheral edge 411*a* over the whole circumference of the window 411 toward the center portion 411*b* and in a direction inclined to the window 411 side.

Thereby, when the gas flowing through the gas flow path 412*c* enters the window side pipe 412*a*, the gas may flow from the peripheral edge 41 la over the whole circumference of the window 411 toward the center portion 411*b* while being blown to the window 411.

In other words, the gas supply unit 71 illustrated in FIG. 12 may supply gas into the optical path pipe 412 such that the gas is blown to the window 411 from the peripheral edge 411*a* over the whole circumference of the window 411 toward the center portion 411*b*.

The other part of the configuration of the light source unit 410 according to Modification 1 of the first embodiment may be the same as that of the light source unit 410 of the first embodiment.

The other part of the configuration of the EUV light generation device 1 according to Modification 1 of the first embodiment may be the same as that of the EUV light generation device 1 of the first embodiment.

The window 411 may be heated by being irradiated with the scattered light of the pulse laser light 33 and the plasma light to thereby generate a thermal lens effect by the window 411 itself.

In the EUV light generation device 1 of Modification 1 of the first embodiment, gas is blown to the window 411. Accordingly, heating of the window 411 can be suppressed, and the thermal lens effect of the window 411 itself can be suppressed. Therefore, in the EUV light generation device 1 of Modification 1 of the first embodiment, deviation of the focusing position of the light output from the light source 413 can be even more suppressed.

Consequently, in the EUV light generation device 1 of Modification 1 of the first embodiment, the pass timing of the droplet 271 can be detected with much higher accuracy, and the output timing of the pulse laser light 31 can be controlled with much higher accuracy.

7. EUV Light Generation Device of Second Embodiment

An EUV light generation device 1 of a second embodiment will be described with reference to FIGS. 13 and 14.

In the above description, it has been described that a thermal lens may be formed in the optical path pipe 412 included in the light source unit 410 by the heat generated in the wall 2*a* of the chamber 2 by being irradiated with the scattered light of the pulse laser light 33 and the plasma light, and that a droplet detection signal may be generated at wrong timing.

Such a phenomenon may be generated even in an optical path pipe 422 included in the light receiving unit 420 mounted on the wall 2*a* of the chamber 2, in the same manner as in the optical path pipe 412.

That is, a thermal lens may be formed in the optical path pipe 422 by the heat generated in the wall 2*a* of the chamber 2 with irradiation of the scattered light of the pulse laser light 33 and the plasma light.

Thereby, on the light receiving surface of the light receiving element 423, an image at a position deviated from the predetermined position P of the light output from the light source 413 into the chamber 2 may be transferred.

Consequently, an appropriate pass timing signal may not be output from the light receiving element 423, and a droplet detection signal may be generated at wrong timing.

In the EUV light generation device 1 of the second embodiment, the configuration of the optical path pipe 422 of the light receiving unit 420 may be the same as that of the optical path pipe 412 of the first embodiment. Further, the EUV light generation device 1 of the second embodiment may have a configuration in which a gas supply unit 72 that is the same as the gas supply unit 71 of the first embodiment is added.

Regarding the configuration of the EUV light generation device 1 of the second embodiment, description of the configuration that is the same as the configuration of the EUV light generation device 1 illustrated in FIGS. 2 to 5 and the EUV light generation device 1 of the first embodiment is omitted.

Figure 13:
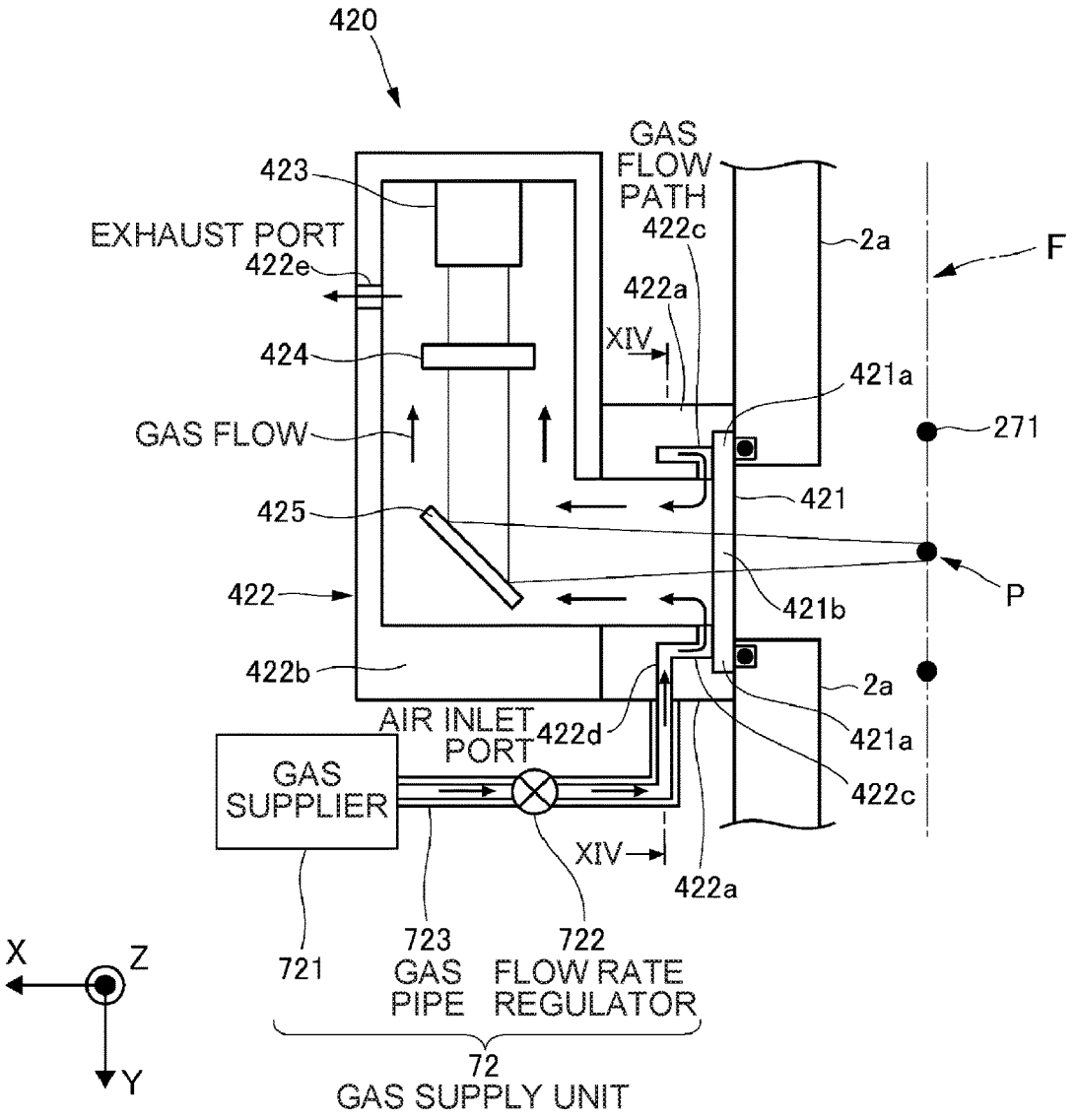
FIG. 13 is a diagram for explaining a configuration of a gas supply unit and a light receiving unit according to a second embodiment.
Figure 14:
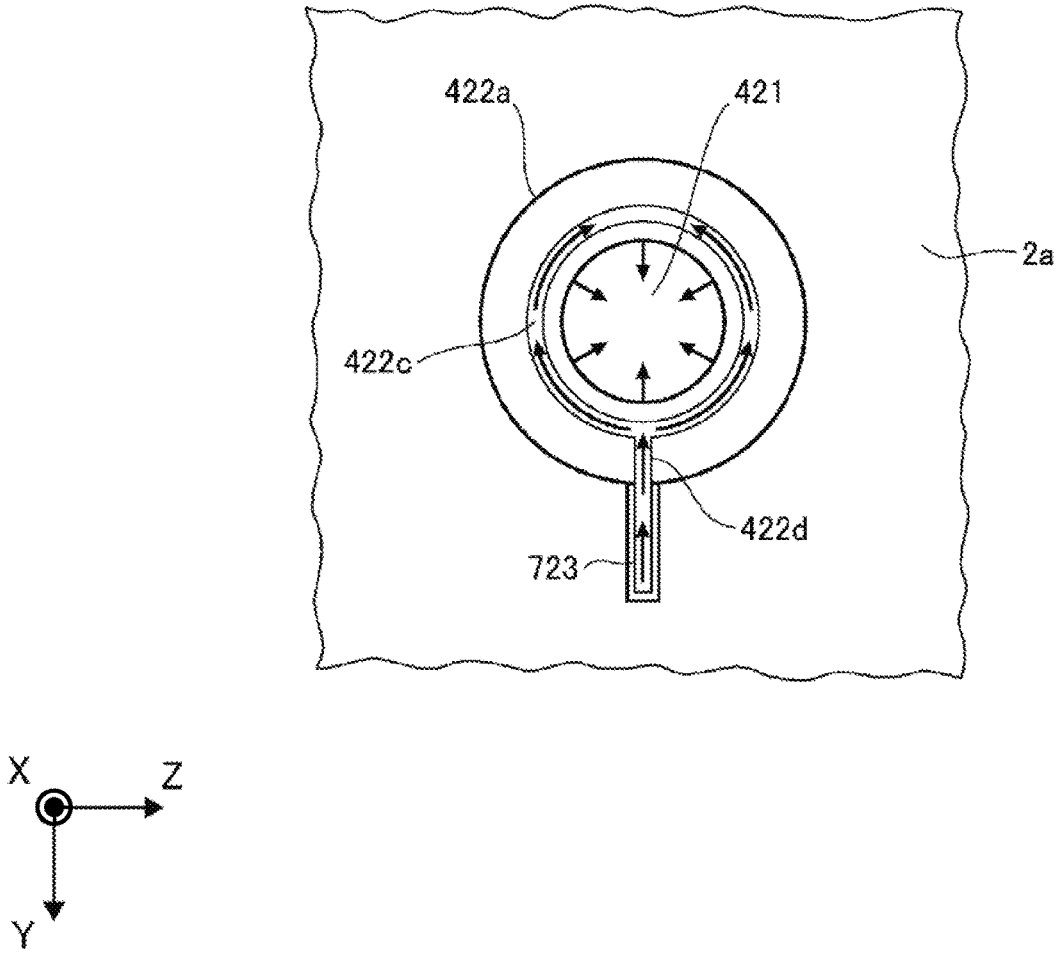
FIG. 14 is a cross-sectional view taken along a line XIV-XIV illustrated in FIG. 13.

FIG. 13 is a diagram for explaining configurations of the gas supply unit 72 and the light receiving unit 420 according to the second embodiment. FIG. 14 is a cross-sectional view taken along the line XIV-XIV illustrated in FIG. 13.

The gas supply unit 72 may supply gas into the optical path pipe 422.

The gas supply unit 72 may include a gas supplier 721, a flow rate regulator 722, and a gas pipe 723.

The gas supplier 721 may be disposed outside of the chamber 2 and the optical path pipe 422.

The gas supplier 721 may be connected to the optical path pipe 422 via the gas pipe 723.

The flow rate regulator 722 may be a device that regulates the flow rate of the gas supplied from the gas supplier 721 into the optical path pipe 422, The other part of the configuration of the gas supply unit 72 according to the second embodiment may be the same as that of the gas supply unit 71 of the first embodiment.

The optical path pipe 422 may include a window side pipe 422*a*, a light receiving element side pipe 422*b*, a gas flow path 422*c*, an air inlet port 422*d*, and an exhaust port 422*e*.

The air inlet port 422*d* may be an inlet port for supplying gas from the gas supplier 721 into the optical path pipe 422.

The air inlet port 422*d* may be provided at an end portion on the window 421 side on the wall of the window side pipe 422*a*, similar to the air inlet port 412*d*.

The air inlet port 422*d* may be configured of a through hole penetrating the wall of the window side pipe 422*a*, similar to the air inlet port 412*d*.

To the air inlet port 422*d*, the gas pipe 723 may be connected, similar to the air inlet port 412*d*.

The gas flow path 422*c* may be a channel for allowing the gas flowing from the air inlet port 422*d* to pass through the wall of the optical path pipe 422, similar to the gas flow path 412*c*.

The gas flow path 422*c* may be provided inside the wall of the window side pipe 422*a* and in the vicinity of the air inlet port 422*d*, similar to the gas flow path 412*c*.

The gas flow path 422*c* may be formed along the circumferential direction of the inner wall surface of the window side pipe 422*a*, similar to the gas flow path 412*c*. The gas flow path 422*c* may be formed along the peripheral edge 421*a* of the window 421 held by the window side pipe 422*a*.

The gas flow path 412*c* may be formed such that the surface on the inner wall surface side of the window side pipe 422*a* is opened over the whole circumference of the inner wall surface to communicate with the inner space of the window side pipe 422*a*, similar to the gas flow path 412*c*. The opening may be opened along a direction from the peripheral edge 421*a* over the whole circumference of the window 421 to a center portion 421*b*.

The gas flow path 422*c* may have a through hole formed to penetrate from a portion of a surface on the inner wall surface of the window side pipe 422*a* to a portion of the outer wall surface of the window side pipe 422*a*, and communicate with the outside of the window side pipe 422*a*, similar to the gas flow path 412*c*. The through hole may constitute the air inlet port 422*d*.

The exhaust port 422*e* may be an outlet port for discharging the gas in the optical path pipe 422 to the outside of the optical path pipe 422.

The exhaust port 422*e* may be provided in an end portion of the light receiving element 423 side of the wall of the light receiving element side pipe 422*b*, similar to the exhaust port 412*e*.

The exhaust port 422*e* may be configured of a through hole penetrating the wall of the light receiving element side pipe 422*b*, similar to the exhaust port 412*e*.

The other part of the configuration of the light receiving unit 420 according to the second embodiment may be the same as that of the light receiving unit 420 illustrated in FIGS. 2 and 4.

The other part of the configuration of the EUV light generation device 1 according to the second embodiment may be the same as that of the EUV light generation device 1 illustrated in FIGS. 2 to 5.

With the configuration described above, the gas supply unit 72 according to the second embodiment may generate a gas flow in the optical path pipe 422 by supplying gas into the optical path pipe 422 and make the temperature distribution of the gas in the optical path pipe 422 substantially uniform.

Therefore, the gas supply unit 72 may suppress generation of refractive index distribution in the optical path pipe 422 and suppress formation of a thermal lens in the optical path pipe 422.

Accordingly, the gas supply unit 72 may suppress formation of an image transferred to the light receiving surface of the light receiving element 423 at a position deviated from the predetermined position P.

Thereby, the droplet detector 41 according to the second embodiment can output an appropriate pass timing signal from the light receiving element 423. Accordingly, the droplet detector 41 can detect the pass timing of the droplet 271 at the predetermined position P with high accuracy.

As a result, the EUV light generation device 1 of the second embodiment can suppress output of a trigger signal to the laser device 3 at wrong timing, and can control the output timing of the pulse laser light 31 from the laser device 3 with high accuracy.

Further, the gas supply unit 72 of the second embodiment can supply gas into the optical path pipe 422 such that the gas flows from the peripheral edge 421*a* to the center portion 421*b* of the window 421, similar to the gas supply unit 71 of the first embodiment. Moreover, the gas supply unit 72 can supply gas into the optical path pipe 422 such that the gas flows from the high temperature side to the lower temperature side of the optical path pipe 422.

Thereby, in the EUV light generation device 1 of the second embodiment, the temperature distribution of the gas in the optical path pipe 422 can be made even more uniform and the refractive index distribution in the optical path pipe 422 can be even more suppressed. Therefore, deviation from the predetermined position P of the image transferred to the light receiving surface of the light receiving element 423 can be even more suppressed.

Consequently, in the EUV light generation device 1 of the second embodiment, the pass timing of the droplet 271 can be detected with much higher accuracy, and the output timing of the pulse laser light 31 can be controlled with much higher accuracy, similar to the EUV light generation device 1 of the first embodiment.

It should be noted that the gas supply unit 72 of the second embodiment may supply gas into the optical path pipe 422 such that the gas is blown to the window 421 from the peripheral edge 421*a* over the whole circumference of the window 421 to the center portion 421*b*, similar to the gas supply unit 71 according to Modification 1 of the first embodiment.

Further, in the droplet detector 41 of the second embodiment, not only the light receiving unit 420 but also the light source unit 410 may have a configuration that is the same as the configuration of the light source unit 410 according to the first embodiment. In that case, the gas supply unit 72 may supply gas not only into the optical path pipe 422 included in the light receiving unit 420 but also into the optical path pipe 412 included in the light source unit 410. Alternatively, the EUV light generation device 1 of the second embodiment may be provided with the gas supply unit 71 of the first embodiment, in addition to the gas supply unit 72.

8. EUV Light Generation Device of Third Embodiment

An EUV light generation device 1 of a third embodiment will be described with use of FIG. 15.

Figure 15:
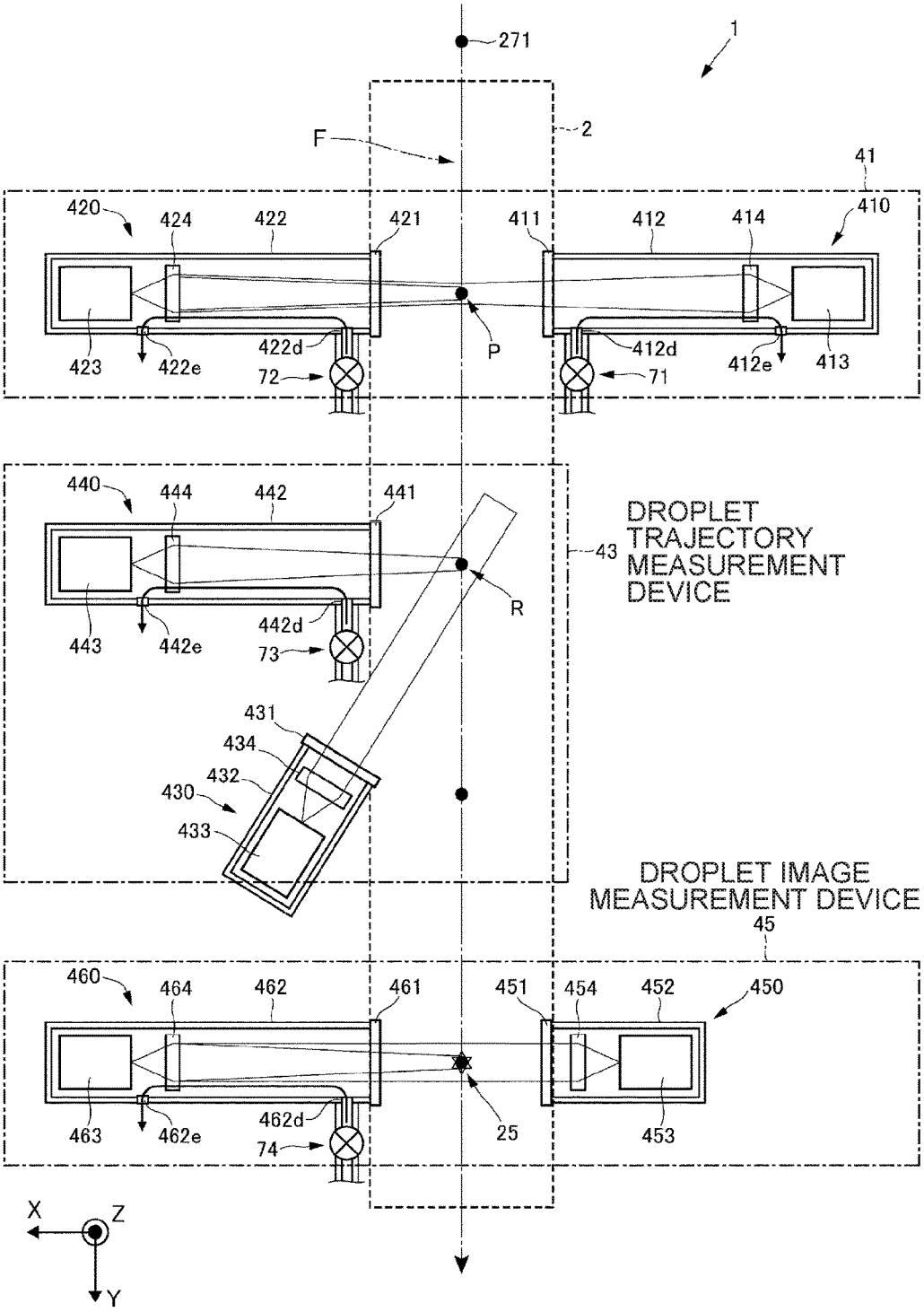
FIG. 15 is a diagram for explaining a configuration of an EUV light generation device of a third embodiment.

FIG. 15 is a diagram for explaining a configuration of the EUV light generation device 1 of the third embodiment.

In the EUV light generation device 1 of the third embodiment, the droplet detector 41 may include a light source unit 410 that is the same as that of the first embodiment, and a light receiving unit 420 that is the same as that of the second embodiment. Along with it, the EUV light generation device 1 of the third embodiment may include a gas supply unit 71 that is the same as that of the first embodiment and a gas supply unit 72 that is the same as that of the second embodiment.

The EUV light generation device 1 of the third embodiment may have a configuration in which a droplet trajectory measurement device 43 and a droplet image measurement device 45 are added to the EUV light generation device 1 of the second embodiment. Further, the EUV light generation device 1 of the third embodiment may have a configuration in which gas supply units 73 and 74 that are the same as the gas supply unit 72 of the second embodiment are added.

Regarding the configuration of the EUV light generation device 1 of the third embodiment, description of the configuration that is the same as the configuration of the EUV light generation device 1 of the first or second embodiment is omitted.

8.1 Droplet Detector

In the droplet detector 41 of the third embodiment, gas may be supplied from the gas supply unit 71 into the optical path pipe 412 of the light source unit 410, similar to the first embodiment.

In the droplet detector 41, gas may be supplied from the gas supply unit 72 into the optical path pipe 422 of the light receiving unit 420, similar to the second embodiment.

Thereby, in the EUV light generation device 1 of the third embodiment, an appropriate pass timing signal can be output from the light receiving element 423. Therefore, pass timing of the droplet 271 at the predetermined position P can be detected with high accuracy.

Consequently, the EUV light generation device 1 of the third embodiment can suppress output of a trigger signal to the laser device 3 at wrong timing, and can control the output timing of the pulse laser light 31 from the laser device 3 with high accuracy.

8.2 Droplet Trajectory Measurement Device

The droplet trajectory measurement device 43 may be a sensor configured to measure the droplet trajectory F at a predetermined position R between the predetermined position P and the plasma generation region 25.

The droplet trajectory measurement device 43 may include a light source unit 430 and a light receiving unit 440.

The light source unit 430 and the light receiving unit 440 may be mounted on the wall 2*a* of the chamber 2, similar to the case of the light source unit 410 and the light receiving unit 420 included in the droplet detector 41.

However, the light source unit 430 and the light receiving unit 440 may not he disposed opposite to each other over the droplet trajectory F.

The light source unit 430 and the light receiving unit 440 may be disposed such that the window 431 of the light source unit 430 and the window 441 of the light receiving unit 440 face the predetermined position R from the same direction not in parallel. The window 431 of the light source unit 430 and the window 441 of the light receiving unit 440 may be disposed such that the light receiving unit 440 can detect reflected light from the droplet 271.

The light source unit 430 may include a window 431, an optical path pipe 432, a light source 433, and an illumination optical system 434, similar to the light source unit 410 included in the droplet detector 41.

However, in the light source unit 430, gas such as CDA may not be supplied to the inside of the optical path pipe 432, which is different from the case of the optical path pipe 412 of the light source unit 410. Alternatively, gas such as CDA may be supplied to the inside of the optical path pipe 432, similar to the case of the optical path pipe 412. In the case where gas such as CDA is supplied into the optical path pipe 432, the wall of the optical path pipe 432 may be provided with an air inlet port and a gas flow path on the window 431 side and provided with an exhaust port on a light source 433 side, similar to the case of the optical path pipe 412.

Further, the illumination optical system 434 may be configured to collimate the light output from the light source 433 and output it toward the predetermined position R. The illumination optical system 434 may focus light output from the light source 433.

The other part of the light source unit 430 may be the same as that of the light source unit 410, The light receiving unit 440 may include a window 441, an optical path pipe 442, a light receiving element 443, and a light receiving optical system 444, similar to the light receiving unit 420 included in the droplet detector 41.

To the inside of the optical path pipe 442 of the light receiving unit 440, gas such as CDA may be supplied from the gas supply unit 73, similar to the case of the optical path pipe 422 of the light receiving unit 420.

However, the light receiving element 443 of the light receiving unit 440 may be a two-dimensional image sensor configured by using a CCD (Charge-Coupled Device) and an image intensifier.

The other part of the configuration of the light receiving unit 440 may be the same as that of the light receiving unit 420.

Operation of the droplet trajectory measurement device 43 will be described.

The light source 433 of the light source unit 430 may output light to the predetermined position R in the chamber 2 via the illumination optical system 434 and the window 431.

When the droplet 271 output into the chamber 2 passes through the predetermined position R, the light output from the light source 433 may irradiate the droplet 271. The light radiated to the droplet 271 may be reflected by the droplet 271. The reflected light may be received by the light receiving unit 440.

The light receiving optical system 444 of the light receiving unit 440 may transfer an image at the predetermined position R of the reflected light from the droplet 271 to the light receiving surface of the light receiving element 443.

The light receiving element 443 of the light receiving unit 440 may capture an image of the reflected light transferred by the light receiving optical system 444. The light receiving element 443 may measure the droplet trajectory F from the acquired image. The light receiving element 443 may output a signal representing the measurement result of the droplet trajectory F to the controller 8.

The controller 8 may control the droplet trajectory F to a desired trajectory based on the measurement result. For example, the controller 8 may control the droplet trajectory F to a desired trajectory by moving a biaxial stage, not illustrated, on which the target supply unit 26 is mounted, based on the measurement result.

As described above, the droplet trajectory measurement device 43 may include the light receiving unit 440 mounted on the wall 2*a* of the chamber 2, similar to the case of the droplet detector 41.

That is, the light receiving unit 440 of the droplet trajectory measurement device 43 may be heated by the heat generated in the wall 2*a* of the chamber 2 with irradiation of the scattered light of the pulse laser light 33 and the plasma light, similar to the case of the light receiving unit 420 of the droplet detector 41. Accordingly, in the optical path pipe 442 included in the light receiving unit 440, a thermal lens may be formed, similar to the case of the optical path pipe 422 included in the light receiving unit 420.

Thereby, to the light receiving surface of the light receiving element 443 included in the light receiving unit 440, an image at a position deviated from the predetermined position R of the reflected light from the droplet 271 may be transferred.

As a result, the measurement accuracy of the droplet trajectory F in the light receiving element 443 may be deteriorated and the droplet trajectory F may not be controlled appropriately. Thereby, the pulse laser light 33 may not be radiated to the droplet 271 appropriately.

However, in the EUV light generation device 1 of the third embodiment, to the inside of the optical path pipe 442 of the light receiving unit 440, gas such as CDA may be supplied from the gas supply unit 73, similar to the case of the optical path pipe 422 of the light receiving unit 420.

Thereby, in the EUV light generation device 1 of the third embodiment, formation of a thermal lens in the optical path pipe 442 can be suppressed, and it is also possible to suppress formation of an image to be transferred to the light receiving surface of the light receiving element 443 at a position deviated from the predetermined position R of the reflected light of the droplet 271.

Consequently, in the EUV light generation device 1 of the third embodiment, the measurement accuracy of the droplet trajectory F in the light receiving element 443 can be secured and the droplet trajectory F can be controlled appropriately, whereby the pulse laser light 33 can be radiated to the droplet 271 appropriately.

8.3 Droplet Image Measurement Device

The droplet image measurement device 45 may be a sensor configured to capture an image of the droplet 271 immediately before it reaches the plasma generation region 25 or the droplet 271 having reached the plasma generation region 25.

The droplet image measurement device 45 may include a light source unit 450 and a light receiving unit 460.

The light source unit 450 and the light receiving unit 460 may be mounted on the wall 2*a* of the chamber 2, similar to the case of the light source unit 430 and the light receiving unit 440 included in the droplet trajectory measurement device 43.

The light source unit 450 and the light receiving unit 460 may be disposed to face each other over the droplet trajectory F.

The facing direction between the light source unit 450 and the light receiving unit 460 may substantially orthogonal to the droplet trajectory F.

The light source unit 450 may include a window 451, an optical path pipe 452, a light source 453, and an illumination optical system 454, similar to the case of the light source unit 430 included in the droplet trajectory measurement device 43.

However, into the optical path pipe 452 of the light source unit 450, gas such as CDA may be supplied or may not be supplied, similar to the case of the optical path pipe 432 of the light source unit 430. In the case where gas such as CDA is supplied into the optical path pipe 452, the wall of the optical path pipe 452 may be provided with an air inlet port and a gas flow path on the window 451 side and an exhaust port on the light source 453 side, similar to the optical path pipe 432.

The other part of the configuration of the light source unit 450 may be the same as that of the light source unit 430.

The light receiving unit 460 may include a window 461, an optical path pipe 462, a light receiving element 463, and a light receiving optical system 464, similar to the case of the light receiving unit 440 included in the droplet trajectory measurement device 43.

To the inside of the optical path pipe 462 of the light receiving unit 460, gas such as CDA may be supplied from a gas supply unit 74, similar to the case of the optical path pipe 442 of the light receiving unit 440.

The light receiving element 463 of the light receiving unit 460 may be a two-dimensional image sensor configured by using a CCD (Charge-Coupled Device) and an image intensifier, similar to the case of the light receiving element 443 of the light receiving unit 440.

The other part of the configuration of the light receiving unit 460 may be the same as that of the light receiving unit 440.

Operation of the droplet image measurement device 45 will be described.

The light source 453 of the light source unit 450 may output light to the plasma generation region 25 in the chamber 2 via the illumination optical system 454 and the window 451.

When the droplet 271 output into the chamber 2 reaches the plasma generation region 25, part of the light output from the light source 453 and traveling to the light receiving unit 460 may be shielded. As such, when the droplet 271 reaches the plasma generation region 25, a part of the image at the plasma generation region 25 of the light output from the light source 453 may become a shadow image of the droplet 271 that reached the plasma generation region 25 and may be transferred to the light receiving surface of the light receiving element 463. In other words, when the droplet 271 reaches the plasma generation region 25, in the light receiving unit 460, the light receiving element 463 may receive light not shielded by the droplet 271 and passing the periphery thereof, of the light output from the light source 453 and radiated to the droplet 271.

The light receiving optical system 464 of the light receiving unit 460 may transfer the shadow image of the droplet 271 in the plasma generation region 25 to the light receiving surface of the light receiving element 463.

The light receiving element 463 of the light receiving unit 460 may capture the shadow image of the droplet 271 transferred by the light receiving optical system 464. The light receiving element 463 may measure the traveling velocity of the droplet 271 from the acquired image. The light receiving element may output a signal representing the measurement result of the traveling velocity of the droplet 271 to the controller 8.

The controller 8 may correct a delay time Td defining the timing of outputting a trigger signal based on the measurement result.

As described above, the droplet image measurement device 45 may include the light receiving unit 440 mounted on the wall 2*a* of the chamber 2, similar to the droplet trajectory measurement device 43.

That is, the light receiving unit 460 of the droplet image measurement device 45 may be heated by the heat generated in the wall 2*a* of the chamber 2 with irradiation of the scattered light of the pulse laser light 33 and the plasma light, similar to the light receiving unit 440 of the droplet trajectory measurement device 43. Accordingly, in the optical path pipe 462 included in the light receiving unit 460, a thermal lens may be formed, similar to the optical path pipe 442 of the light receiving unit 440.

Thereby, on the light receiving surface of the light receiving element 463 included in the light receiving unit 460, a shadow image of the droplet 271 at a position deviated from the plasma generation region 25 may be transferred.

As a result, the measurement accuracy of the traveling velocity of the droplet 271 in the light receiving element 463 may be deteriorated and the delay time Td may not be corrected appropriately, whereby the pulse laser light 33 may not be radiated to the droplet 271 appropriately. In particular, the radiation position of the pulse laser light 33 to the droplet 271 may be deviated from a desired position and the light emitting efficiency of the EUV light 252 may drop.

However, in the EUV light generation device 1 of the third embodiment, to the inside of the optical path pipe 462 included in the light receiving unit 460, gas such as CDA may be supplied from the gas supply unit 74, similar to the optical path pipe 442 of the light receiving unit 440.

Thereby, in the EUV light generation device 1 of the third embodiment, it is possible to suppress formation of a thermal lens in the optical path pipe 462 and to suppress that an image transferred to the light receiving surface of the light receiving element 463 becomes a shadow image of the droplet 271 at a position deviated from the plasma generation region 25.

Consequently, in the EUV light generation device 1 of the third embodiment, it is possible to secure the measurement accuracy of the traveling velocity of the droplet 271 in the light receiving element 463 to correct the delay time Td appropriately. Thereby, the pulse laser light 33 can be radiated to the droplet 271 appropriately. In particular, it is possible to control the radiation position of the pulse laser light 33 to the droplet 271 to a desired position, to thereby suppress drop of the light emitting efficiency of the EUV light 252.

It should be noted that while the gas supply units 71 to 74 of the third embodiment are not illustrated in FIG. 15, the gas supply units 71 to 74 may supply gas such that the gas flows from the respective peripheral edges of the windows 411, 421, 441 and 461 to the center portion, similar to the gas supply unit 71 of the first embodiment.

Further, the gas supply units 71 to 74 of the third embodiment may supply gas such that the gas is blown to the respective windows 411, 421, 441 and 461, similar to the gas supply unit 71 of Modification 1 of the first embodiment.

9. EUV Light Generation Device of Fourth Embodiment

An EUV light generation device 1 of a fourth embodiment will be described with use of FIGS. 16 and 17.

In the EUV light generation device 1 of the fourth embodiment, a droplet detector 41 may include a light source unit 410 that is the same as that of the first embodiment and a light receiving unit 420 that is the same as that of the second embodiment. The EUV light generation device 1 of the fourth embodiment may have a configuration further including a gas supply unit 75 in which the gas supply unit 71 of the first embodiment and the gas supply unit 72 of the second embodiment are combined.

Regarding the configuration of the EUV light generation device 1 of the fourth embodiment, description of the configuration that is the same as that of the EUV light generation device 1 of the first to third embodiments is omitted.

9.1 Configuration

Figure 16:
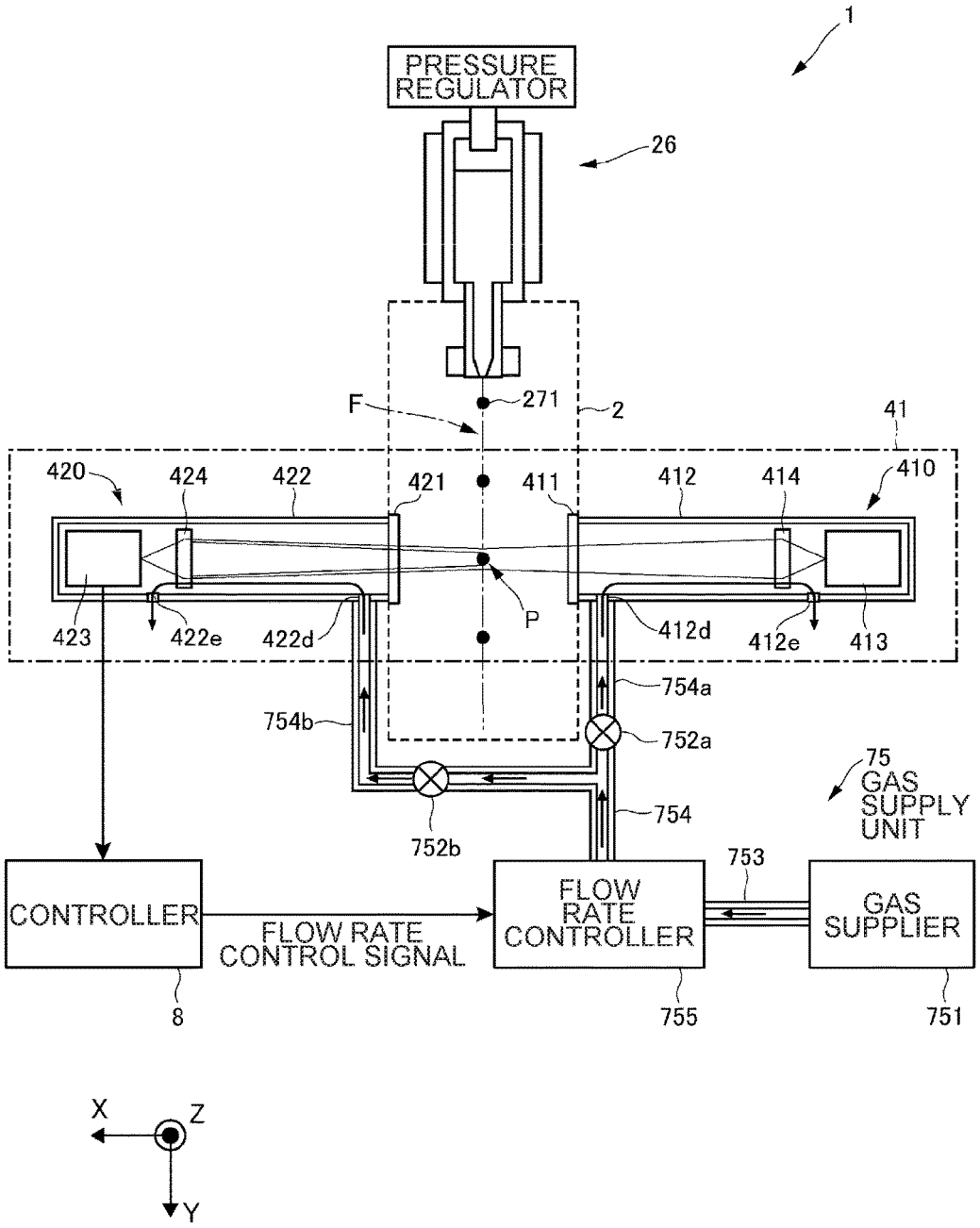
FIG. 16 is a diagram for explaining a configuration of an EUV light generation device of a fourth embodiment.

FIG. 16 is a diagram for explaining a configuration of the EUV light generation device 1 of the fourth embodiment.

The gas supply unit 75 of the fourth embodiment may supply gas such as CDA to the respective optical path pipes 412 and 422 included in the light source unit 410 and the light receiving unit 420 of the droplet detector 41.

The gas supply unit 75 may change the flow rate of the gas supplied into the optical path pipes 412 and 422, corresponding to a change in the light receiving intensity of the light receiving element 423.

The gas supply unit 75 may include a gas supplier 751, a flow rate regulator 752*a*, a flow rate regulator 752*b*, a gas pipe 753, a gas pipe 754, and a flow rate controller 755.

The gas pipe 753 m,ay connect the gas supplier 751 and the flow rate controller 755.

The gas pipe 754 may connect the air inlet port 412*d* of the optical path pipe 412 and the flow rate controller 755, and the air inlet port 422*d* of the optical path pipe 422 and the flow rate controller 755, respectively. The gas pipe 754 may be configured such that a pipe extending from the flow rate controller 755 is branched into a first portion 754*a* extending toward the air inlet port 412*d* and a second portion 754*b* extending toward the air inlet port 422*d*.

The gas pipe 753 and the gas pipe 754 may communicate with each other in the flow rate controller 755.

The flow rate controller 755 may be a device that controls a flow rate of the entire gas supplied from the gas supplier 751 into the optical path pipes 412 and 422. The flow rate controller 755 may be a mass flow rate controller.

Operation of the flow rate controller 755 may be controlled by the controller 8. The flow rate controller 755 may control the flow rate of the gas supplied from the gas supplier 751 into the optical path pipes 412 and 422 based on a flow rate control signal output from the controller 8.

The flow rate regulator 752*a* may be provided on the first portion 754*a* of the gas pipe 754. The flow rate regulator 752*a* may be a valve or an orifice. The flow rate regulator 752*a* may regulate a flow rate of gas supplied from the flow rate controller 755 into the optical path pipe 412.

The flow rate regulator 752*b* may be provided on the second portion 754*b* of the gas pipe 754. The flow rate regulator 752*b* may be a valve or an orifice. The flow rate regulator 752*b* may regulate a flow rate of gas supplied from the flow rate controller 755 into the optical path pipe 422.

Operation of each of the flow rate regulators 752*a* and 752*b* may be controlled by the controller 8.

The other part of the configuration of the gas supply unit 75 of the fourth embodiment may be the same as that of the gas supply units 71 to 74 of the first to third embodiments.

The other part of the configuration of the EUV light generation device 1 of the fourth embodiment may be the same as that of the EUV light generation device 1 of the first to third embodiments.

9.2 Operation

Operation of the EUV light generation device 1 of the fourth embodiment will be described.

Specifically, a flow of operation related to flow rate control of the gas supplied into the optical path pipes 412 and 422 will be described.

Figure 17:
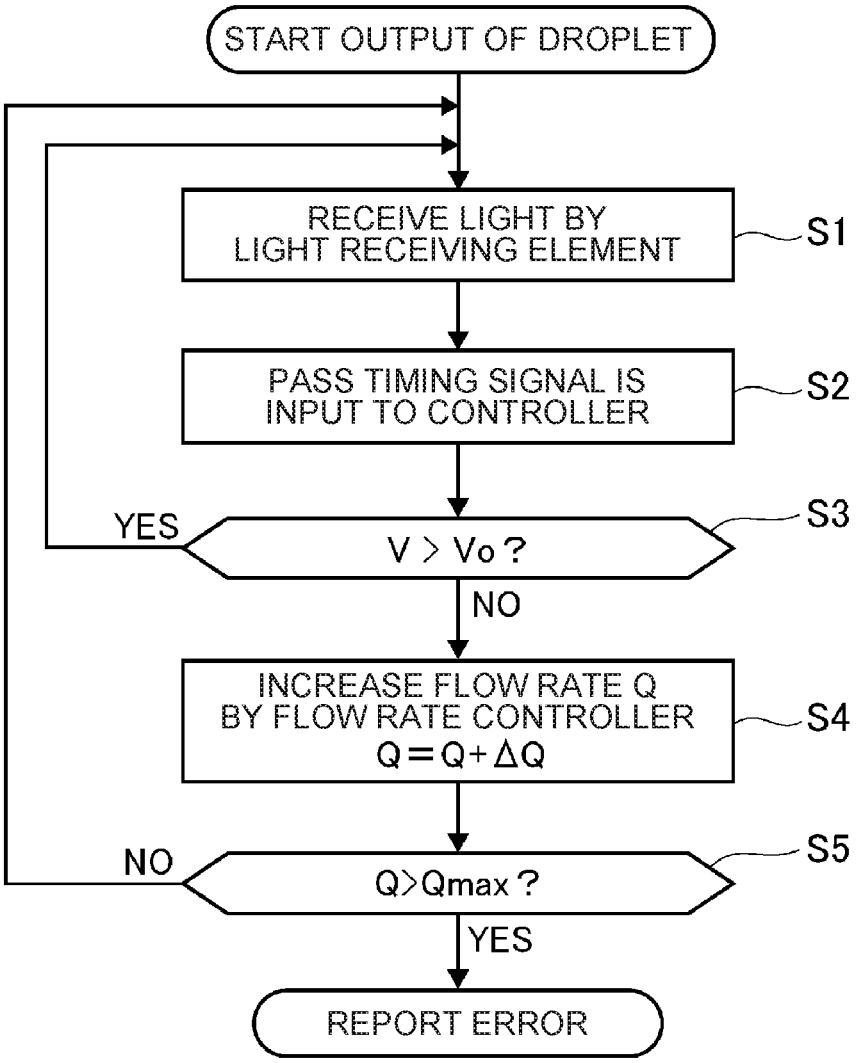
FIG. 17 is a flowchart for explaining operation related to flow rate control of gas supplied into the optical path pipe illustrated in FIG. 16.

FIG. 17 is a flowchart for explaining operation related to flow rate control of the gas supplied into the optical path pipes 412 and 422 illustrated in FIG. 16.

Regarding the operation of the EUV light generation device 1 of the fourth embodiment, description of the operation that is the same as that of the EUV light generation device 1 of the first to third embodiments is omitted.

When a target output signal is input from the EUV light generation controller 5, the controller 8 may control the target supply unit 26 to start output of the droplet 271 into the chamber 2, as described above.

The light source 413 included in the droplet detector 41 may output light to the predetermined position P in the chamber 2.

At step S1, the light receiving element 423 included in the droplet detector 41 may receive light output from the light source 413.

The light receiving element 423 may output a pass timing signal that varies according to the droplet 271 passing through the predetermined position P, to the controller 8, as described above.

At step S2, the pass timing signal output from the light receiving element 423 may be input to the controller 8.

When the droplet 271 does not pass through the predetermined position P, a voltage value V of the pass timing signal may indicate a value higher than a predetermined threshold voltage, as described above.

When the droplet 271 passes through the predetermined position P, the voltage value V of the pass timing signal may indicate a lower value beyond the predetermined voltage. In that case, the controller 8 may generate a droplet detection signal and a trigger signal and output them to the laser device 3, as described above.

At step S3, the controller 8 may determine whether or not the voltage value V of the pass timing signal, in the case where the droplet 271 does not pass through the predetermined position P, is larger than a predetermined voltage target value V0.

As described with use of FIG. 9, when the light receiving intensity of the light receiving element 423 drops along with formation of a thermal lens, the voltage value V of the pass timing signal in the case where the droplet 271 does not pass through the predetermined position P may drop. Along with it, the noise included in the pass timing signal may fall below a predetermined threshold voltage. Accordingly, it is preferable to set the voltage target value V0 to a voltage value with which the noise included in the pass timing signal does not fall below the predetermined threshold voltage when the droplet 271 does not pass through the predetermined position P.

When the voltage value V of the pass timing signal is larger than the voltage target value V0, the controller 8 may proceed to step S1. On the other hand, when the voltage value V of the pass timing signal is not larger than the voltage target value V0, the controller 8 may proceed to step S4.

At step S4, the controller 8 may control the flow rate controller 755 to increase the flow rate Q of the entire gas supplied from the gas supplier 751 into the optical path pipes 412 and 422.

Specifically, the controller 8 may update the flow rate Q set in the flow rate controller 755 with use of the following expression:

$$Q=Q+\Delta Q.$$

ΔQ may be a quantity for regulating the flow rate Q. ΔQ may be determined according to a difference ΔV between the voltage value V of the pass timing signal and the voltage target value V0 in the case where the droplet 271 does not pass through the predetermined position P. The controller 8 may set a larger value to ΔQ as ΔV is smaller.

The controller 8 may output a flow rate control signal representing a new flow rate Q to the flow rate controller 755 to set a new flow rate Q in the flow rate controller 755. The flow rate controller 755 can control the flow rate of the gas supplied from the gas supplier 751 into the optical path pipes 412 and 422 to the new flow rate Q set by the controller 8.

At step S5, the controller 8 may determine whether or not the new flow rate Q set in the flow rate controller 755 is larger than a maximum flow rate Qmax set in advance with use of the following expression:

$$Q>Qmax.$$

When the new flow rate Q set in the flow rate controller 755 is not larger than the maximum flow rate Qmax, the controller 8 may proceed to step S1. On the other hand, when the new flow rate Q set in the flow rate controller 755 is larger than the maximum flow rate Qmax, the controller 8 may report an error.

The maximum flow rate Qmax may be determined in advance based on the CDA supply capability of the gas supplier 751.

The other part of the operation of the EUV light generation device 1 of the fourth embodiment may be the same as that of the EUV light generation device 1 of the first to third embodiments.

9.3 Effect

The energy of the scattered light of the pulse laser light 33 and the plasma light radiated to the wall 2*a* of the chamber 2 may vary according to a change in the pulse energy of the EUV light 252 output from the EUV light generation device 1 and a change in the repetition frequency. That is, the energy of the scattered light of the pulse laser light 33 and the plasma light radiated to the wall 2*a* of the chamber 2 may vary according to the operating state of the EUV light generation device 1.

With a change in the operating state of the EUV light generation device 1, temperature distribution in the optical path pipes 412 and 422 mounted on the wall 2*a* of the chamber 2 may be changed. Therefore, the level of an effect, by the formed thermal lens, on the detection accuracy of the droplet detector 41 may also be changed.

However, the gas supply unit 75 of the fourth embodiment can control the flow rate of the gas supplied into the optical path pipes 412 and 422 according to a change in the pass timing signal output from the light receiving element 423.

As such, the gas supply unit 75 of the fourth embodiment can make the temperature distribution in the optical path pipe 412 and the optical path pipe 422 substantially uniform even when the operating state of the EUV light generation device 1 is changed.

Thereby, the droplet detector 41 of the fourth embodiment can detect the pass timing of the droplet 271 at the predetermined position P with high accuracy, even when the operating state of the EUV light generation device 1 is changed.

Consequently, the EUV light generation device 1 of the fourth embodiment can suppress output of a trigger signal to the laser device 3 at wrong timing, and can control the output timing of the pulse laser light 31 from the laser device 3 with high accuracy.

It should be noted that while the gas supply unit 75 of the fourth embodiment is illustrated in FIG. 16 in a simplified manner, the gas supply unit 75 may supply gas in such a manner that the gas flows from the peripheral edge to the center portion of each of the windows 411 and 421, similar to the gas supply unit 71 of the first embodiment.

Further, the gas supply unit 75 of the fourth embodiment may supply gas such that the gas is blown to the respective windows 411 and 421, similar to the gas supply unit 71 of Modification 1 of the first embodiment.

Further, the EUV light generation device 1 of the fourth embodiment may include the droplet trajectory measurement device 43 and the droplet image measurement device 45, similar to the EUV light generation device 1 of the third embodiment.

In that case, the flow rate of the gas supplied into the optical path pipe included in the droplet trajectory measurement device 43 of the fourth embodiment may be controlled according to the contrast, brightness, and the like of the image acquired by the light receiving element 443. The flow rate of the gas supplied into the optical path pipe included in the droplet image measurement device 45 of the fourth embodiment may be controlled according to the contrast, brightness, and the like of the image acquired by the light receiving element 463.

10. EUV Light Generation Device of Fifth Embodiment

An EUV light generation device 1 of a fifth embodiment will be described with use of FIG. 18.

The EUV light generation device 1 of the fifth embodiment may not supply gas into the optical path pipe. The EUV light generation device 1 of the fifth embodiment may make the temperature distribution in the optical path pipe uniform by agitating the gas in the optical path pipe to make the refractive index distribution in the optical path pipe uniform.

The EUV light generation device 1 of the fifth embodiment may have a configuration including an agitator 91 in place of the gas supply unit 71 relative to the EUV light generation device 1 illustrated in FIGS. 2 to 5.

Regarding the configuration of the EUV light generation device 1 of the fifth embodiment, description of the configuration that is the same as that of the EUV light generation device 1 illustrated in FIGS. 2 to 5 is omitted.

Figure 18:
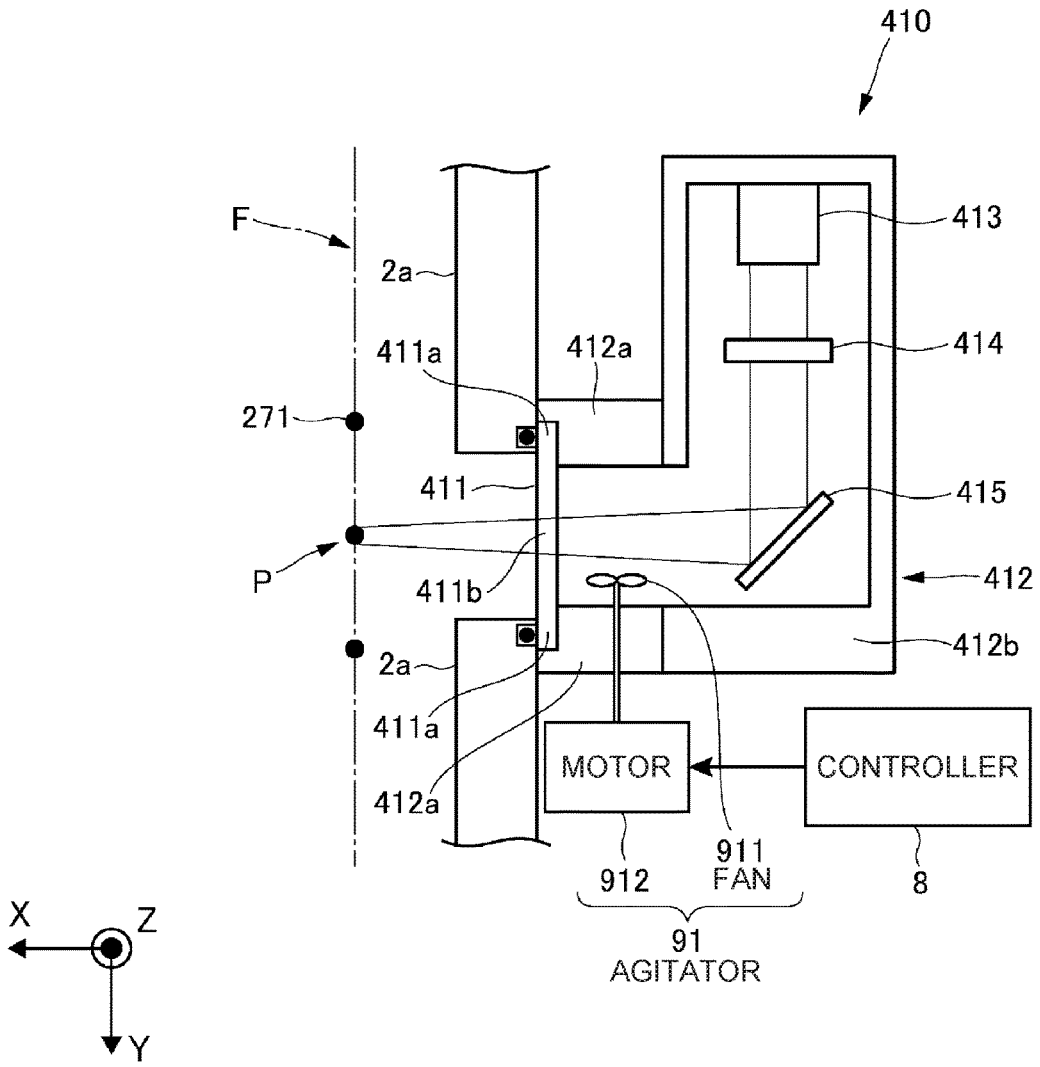
FIG. 18 is a diagram for explaining an agitator and a light source unit according to a fifth embodiment.

FIG. 18 is a diagram for explaining the agitator 91 and the light source unit 410 according to the fifth embodiment.

The agitator 91 may be a device configured to agitate the gas in the optical path pipe 412 to make the temperature distribution uniform to thereby make the refractive index distribution in the optical path pipe uniform.

The agitator 91 may include a fan 911 and a motor 912.

The fan 911 may be disposed in the optical path pipe 412. The fan 911 may be disposed inside the window side pipe 412*a* that is a high temperature side of the optical path pipe 412.

The fan 911 may be rotated by driving of the motor 912.

The motor 912 may be disposed outside of the optical path pipe 412.

Operation of the motor 912 may be controlled by the controller 8.

The motor 912 may change the rotation speed of the fan 911 with control by the controller 8.

The controller 8 may control the rotation speed of the fan 911 by controlling driving of the motor 912 according to a change in the pass timing signal output from the light receiving element 423.

The other part of the operation of the EUV light generation device 1 of the fifth embodiment may be the same as that of the EUV light generation device 1 illustrated in FIGS. 2 to 5.

With the configuration described above, the agitator 91 of the fifth embodiment can regulate the velocity of agitating the gas in the optical path pipe 412 according to a change in the pass timing signal output from the light receiving element 423, similar to the fourth embodiment.

Accordingly, the agitator 91 of the fifth embodiment can make the temperature distribution in the optical path pipe 412 uniform even when the operating state of the EUV light generation device 1 is changed.

Thereby, the droplet detector 41 of the fifth embodiment can detect the pass timing of the droplet 271 at the predetermined position P with high accuracy even when the operating state of the EUV light generation device 1 is changed.

Consequently, the EUV light generation device 1 of the fifth embodiment can suppress output of a trigger signal to the laser device 3 at wrong timing, and can control the output timing of the pulse laser light 31 from the laser device 3 with high accuracy.

11. Others

11.1 Hardware Environment of Each Controller

A person skilled in the art will understand that the subject described herein can be implemented by combining a general purpose computer or a programmable controller and a program module or a software application. In general, a program module includes a routine, a program, a component, a data structure, and the like capable of implementing the processes described in the present disclosure.

Figure 19:
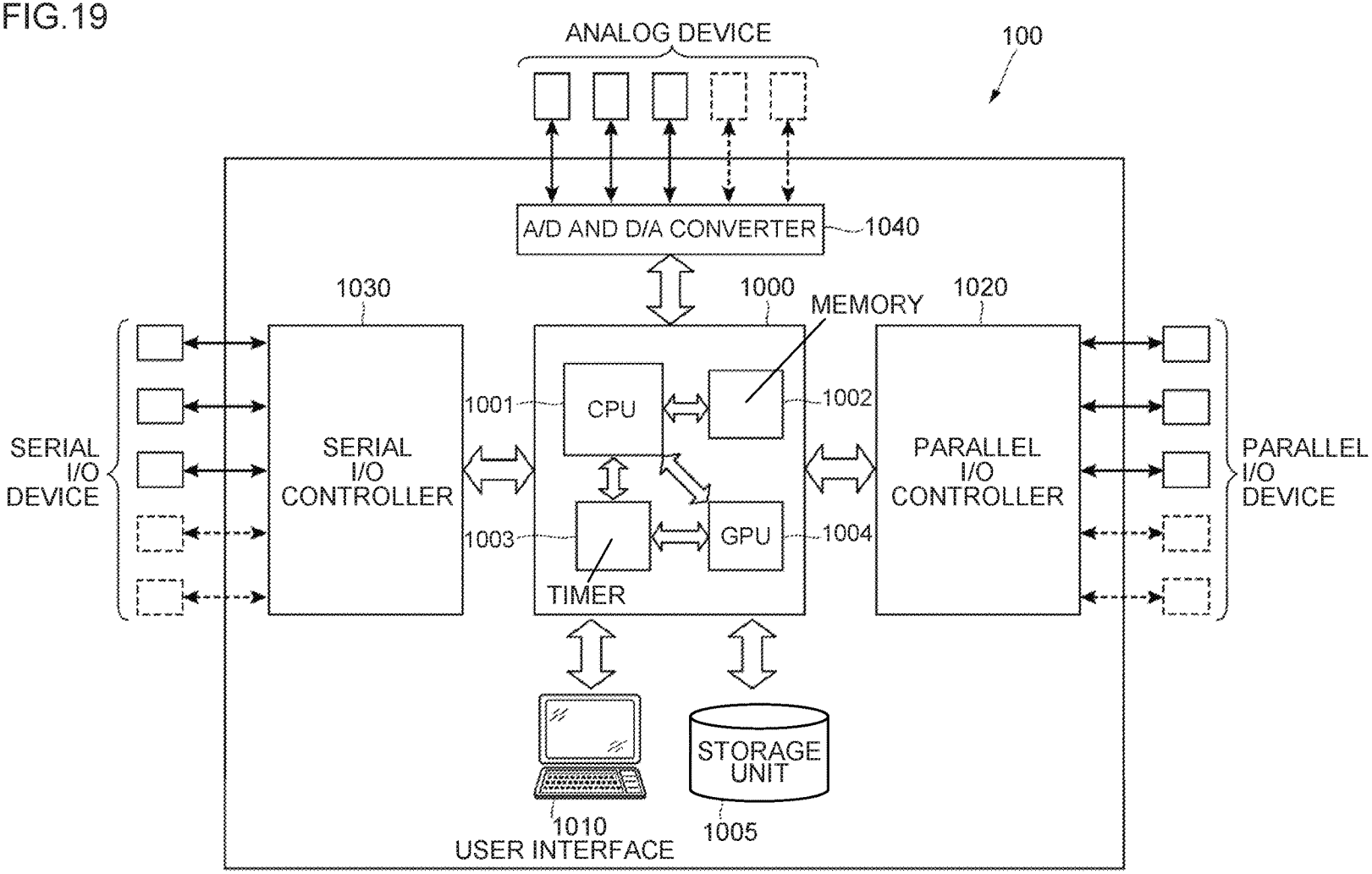
FIG. 19 is a block diagram for explaining a hardware environment of each controller.

FIG. 19 is a block diagram illustrating an exemplary hardware environment in which various aspects of the disclosed subject can be implemented. The exemplary hardware environment 100 of FIG. 19 may include a processing unit 1000, a storage unit 1005, a user interface 1010, a parallel I/O (input/output) controller 1020, a serial I/O controller 1030, an A/D (analog-to-digital) and D/A (digitalto-analog) converter 1040. However, configuration of the hardware environment 100 is not limited to this.

The processing unit 1000 may include a central processing unit (CPU) 1001, a memory 1002, a timer 1003, and an image processing unit (GPU) 1004. The memory 1002 may include a random access memory (RAM) and a read only memory (ROM), The CPU 1001 may be any commercially available processor. A dual microprocessor or another multiprocessor architecture may be used as the CPU 1001.

These constituent elements in FIG. 19 may be connected to each other to perform processes described in the present disclosure.

In the operation, the processing unit 1000 may read and execute a program stored in the storage unit 1005. The processing unit 1000 may also read data along with a program from the storage unit 1005. The processing unit 1000 may also write data to the storage unit 1005. The CPU 1001 may execute a program read from the storage unit 1005. The memory 1002 may be a work region for temporarily storing a program to be executed by the CPU 1001 and data to be used for operation of the CPU 1001. The timer 1003 may measure the time interval and output a measurement result to the CPU 1001 in accordance with execution of a program. The GPU 1004 may process image data according to a program read from the storage unit 1005, and output a processing result to the CPU 1001.

The parallel I/O controller 1020 may be connected to a parallel I/O device communicable with the processing unit 1000, such as the exposure device controller 61, the EUV light generation controller 5, the controller 8, or the like, and may control communication between the processing unit 1000 and such a parallel I/O device. The serial I/O controller 1030 may be connected to a serial I/O device communicable with the processing unit 1000, such as the laser light travel direction controller 34, the heater 263, the pressure regulator 264, the droplet trajectory measurement device 43, the droplet image measurement device 45, the gas supply units 71 to 75, the agitator 91, or the like, and may control communication between the processing unit 1000 and such a serial I/O device. The A/D and D/A converter 1040 may be connected to an analog device such as the target sensor 4, the droplet detector 41, the piezo element 265, or the like, via an analog port, and may control communication between the processing unit 1000 and such an analog device, or perform A/D or D/A conversion of the communication content.

The user interface 1010 may display the progress of a program executed by the processing unit 1000 to the operator such that the operator can instruct the processing unit 1000 to stop the program or execute a cutoff routine.

The exemplary hardware environment 100 may be applied to the configurations of the exposure device controller 61, the EUV light generation controller 5, the controller 8, and other devices of the present disclosure. A person skilled in the art will understand that such controllers may be realized in a distributed computing environment, that is, an environment in which a task is executed by processing units connected over a communication network. In the present disclosure, the exposure device controller 61, the EUV light generation controller 5, the controller 8, and other devices may be connected to each other over a communication network such as Ethernet or the Internet. In a distributed computing environment, a program module may be stored in memory storage devices of both local and remote.

11.2 Other Modifications and the Like

It will be obvious to those skilled in the art that the techniques of the embodiments described above are applicable to each other including the modifications.

The description provided, above is intended to provide just examples without any limitations. Accordingly, it will be obvious to those skilled in the art that changes can be made to the embodiments of the present disclosure without departing from the scope of the accompanying claims.

The terms used in the present description and in the entire scope of the accompanying claims should be construed as terms "without limitations". For example, a term "including" or "included" should be construed as "not limited to that described to include". A term "have" should be construed as "not limited to that described to be held". Moreover, a modifier "a/an" described in the present description and in the accompanying claims should be construed to mean "at least one" or "one or more".

What is claimed is:

1. An extreme ultraviolet light generation device comprising:

a chamber in which plasma is generated to generate extreme ultraviolet light;

a window provided in the chamber;

an optical path pipe connected to the chamber;

a light source disposed in the optical path pipe, the light source being configured to output light into the chamber via the window;

a gas supply unit configured to supply gas into the optical path pipe; and an exhaust port configured to discharge the gas in the optical path pipe to an outside of the optical path pipe.

2. The extreme ultraviolet light generation device according to claim 1, wherein the light source is disposed apart from the window, the gas supply unit supplies the gas from a window side of the optical path pipe into the optical path pipe, and the exhaust port discharges the gas from a light source side of the optical path pipe to the outside of the optical path pipe.

3. The extreme ultraviolet light generation device according to claim 2, wherein the gas supply unit supplies the gas in such a manner that the gas flows from a peripheral edge of the window to a center portion of the window.

4. The extreme ultraviolet light generation device according to claim 2, wherein the gas supply unit supplies the gas in such a manner that the gas is blown to the window.

5. The extreme ultraviolet light generation device according to claim 2, further comprising a target supply unit configured to supply a target into the chamber as a droplet, wherein the plasma is generated from the target when the target is irradiated with laser light, and wherein the light source outputs the light toward the droplet.

6. An extreme ultraviolet light generation device comprising:

a chamber in which plasma is generated to generate extreme ultraviolet light;

a window provided in the chamber;

an optical path pipe connected to the chamber;

a light receiving element disposed in the optical path pipe, the light receiving element being configured to receive light from inside of the chamber via the window;

a gas supply unit configured to supply gas into the optical path pipe; and an exhaust port configured to discharge the gas in the optical path pipe to an outside of the optical path pipe.

7. The extreme ultraviolet light generation device according to claim 6, wherein the light receiving element is disposed apart from the window, the gas supply unit supplies the gas from a window side of the optical path pipe into the optical path pipe, and the exhaust port discharges the gas from a light receiving element side of the optical path pipe to the outside of the optical path pipe.

8. The extreme ultraviolet light generation device according to claim 7, wherein the gas supply unit supplies the gas in such a manner that the gas flows from a peripheral edge of the window to a center portion of the window.

9. The extreme ultraviolet light generation device according to claim 7, wherein the gas supply unit supplies the gas in such a manner that the gas is blown to the window.

10. The extreme ultraviolet light generation device according to claim 7, further comprising a target supply unit configured to supply a target into the chamber as a droplet, wherein the plasma is generated from the target when the target is irradiated with laser light, and wherein the light receiving element receives the light output toward the droplet.

11. The extreme ultraviolet light generation device according to claim 2, further comprising:

a second window provided in the chamber;

a second optical path pipe connected to the chamber;

a light receiving element disposed in the second optical path pipe, the light receiving element being configured to receive light from inside of the chamber via the second window;

a second gas supply unit configured to supply gas into the second optical path pipe; and a second exhaust port configured to discharge the gas from the second optical path pipe.

12. The extreme ultraviolet light generation device according to claim 11, wherein the light receiving element is disposed apart from the second window, the second gas supply unit supplies the gas from a second window side of the second optical path pipe into the second optical path pipe, and the second exhaust port discharges the gas from a light receiving element side of the second optical path pipe to the outside of the second optical path pipe.

13. The extreme ultraviolet light generation device according to claim 12, wherein the second gas supply unit supplies the gas in such a manner that the gas flows from a peripheral edge of the second window to a center portion of the second window.

14. The extreme ultraviolet light generation device according to claim 12, wherein the second gas supply unit supplies the gas in such a manner that the gas is blown to the second window.

15. The extreme ultraviolet light generation device according to claim 12, further comprising a target supply unit configured to supply a target into the chamber as a droplet, wherein the plasma is generated from the target when the target is irradiated with laser light, and wherein the light source outputs the light toward the droplet, and the light receiving element receives the light output toward the droplet.

16. The extreme ultraviolet light generation device according to claim 15, wherein the light receiving element receives the light passing through a periphery of the droplet,of the light output toward the droplet.

17. The extreme ultraviolet light generation device according to claim 15, wherein the light receiving element receives the light reflected by the droplet, of the light output toward the droplet.

18. An extreme ultraviolet light generation device comprising:

a chamber in which plasma is generated to generate extreme ultraviolet light;

a window provided in the chamber;

an optical path pipe connected to the chamber;

a light source disposed in the optical path pipe, the light source being configured to output light into the chamber via the window; and a device configured to make refractive index distribution in the optical path pipe uniform.

19. The extreme ultraviolet light generation device according to claim 18, wherein the device configured to make the refractive index distribution uniform is an agitator configured to agitate gas in the optical path pipe.

* * * * *